US011257635B2

(12) United States Patent
Ruff

(10) Patent No.: US 11,257,635 B2
(45) Date of Patent: Feb. 22, 2022

(54) KEY MODULE FOR A KEYBOARD, AND KEYBOARD

(71) Applicant: Cherry GmbH, Auerbach/Opf (DE)

(72) Inventor: Eduard Ruff, Auerbach (DE)

(73) Assignee: CHERRY GMBH, Auerbach/Opf (DE)

( * ) Notice: Subject to any disclaimer, the term of this patent is extended or adjusted under 35 U.S.C. 154(b) by 0 days.

(21) Appl. No.: 16/760,547

(22) PCT Filed: Jul. 27, 2018

(86) PCT No.: PCT/EP2018/070384
§ 371 (c)(1),
(2) Date: Apr. 30, 2020

(87) PCT Pub. No.: WO2019/086152
PCT Pub. Date: May 9, 2019

(65) Prior Publication Data

US 2020/0294733 A1 Sep. 17, 2020

(30) Foreign Application Priority Data

Oct. 30, 2017 (DE) ..... 10 2017 125 373.4
Feb. 6, 2018 (DE) ..... 10 2018 102 604.8

(51) Int. Cl.
*H01H 3/12* (2006.01)
*H01H 13/70* (2006.01)
(Continued)

(52) U.S. Cl.
CPC ..... *H01H 3/125* (2013.01); *H01H 13/7006* (2013.01); *H01H 13/7073* (2013.01);
(Continued)

(58) Field of Classification Search
CPC ..... H01H 3/125; H01H 13/7006; H01H 13/7073; H01H 13/83; H01H 2221/058;
(Continued)

(56) References Cited

U.S. PATENT DOCUMENTS 6,020,566 A * 2/2000 Tsai ..... H01H 3/122 200/344
6,570,113 B2 * 5/2003 Yu ..... H01H 3/125 200/344
(Continued)

FOREIGN PATENT DOCUMENTS

CN 201011642 Y 1/2008
CN 104299828 1/2015
(Continued)

OTHER PUBLICATIONS

International Search Report for PCT/EP2018/070384, dated Oct. 23, 2018.
(Continued)

*Primary Examiner* — Lheiren Mae A Caroc
(74) *Attorney, Agent, or Firm* — James R. Hayne; Stites & Harbison PLLC

(57) ABSTRACT

What is presented is a key module for a keyboard. The key module includes a first wing element and a second wing element for guiding a movement of the key module upon actuation. Each wing element includes a bar, a first arm and a second arm. The arms extend away from the bar. A mounting portion is formed on the bar. A first bearing portion for bearing the wing element is formed on the first arm. A second bearing portion for bearing the wing element is formed on the second arm. The first wing element and the second wing element are mechanically coupleable to each other. The key module also includes at least one spring element for providing a reset force upon actuation of the key module. The at least one spring element is mountable to the mounting portion of the first wing element and the mounting portion of the second wing element. The key module further includes a support element for supporting the wing elements. A plurality of accommodating portions for accom-
(Continued)

modating the bearing portions of the wing elements are formed in the support element.

20 Claims, 21 Drawing Sheets

(51) Int. Cl.
*H01H 13/7073* (2006.01)
*H01H 13/83* (2006.01)

(52) U.S. Cl.
CPC ..... *H01H 13/83* (2013.01); *H01H 2221/058* (2013.01); *H01H 2233/07* (2013.01)

(58) Field of Classification Search
CPC ..... H01H 2233/07; H01H 2237/004; H01H 13/7065; H01H 3/02; H01H 3/12; H01H 3/32; H01H 3/38; H01H 3/42; H01H 13/705; H01H 13/14; H01H 13/70; H01H 13/704; H01H 13/7057; H01H 13/78; H01H 13/79; H01H 13/52; H01H 13/703; H01H 13/507; H01H 13/7013; H01H 13/20; H01H 13/22; H01H 13/26; H01H 13/28; H01H 13/285; H01H 13/50; H01H 13/506; H01H 13/84; H01H 13/85; H01H 5/04; H01H 5/06; H01H 2221/036; H01H 2221/044; H01H 2221/062; H01H 2013/525; H01H 2233/03; H01H 2233/00; H01H 2233/05; H01H 2235/00; H01H 2235/01; H01H 2235/018; H01H 2235/016; H01H 3/48; H01H 3/60; H01H 2215/028; H01H 2227/028; G06F 3/0202; G06F 3/02
USPC ..... 200/341, 344, 345
See application file for complete search history.

(56) References Cited

U.S. PATENT DOCUMENTS

| | | | | |
|---|---|---|---|---|
| 7,138,587 | B2 | 11/2006 | Nishino et al. | |
| 7,345,253 | B2 * | 3/2008 | Hsu | G10H 1/346 200/344 |
| 10,529,504 | B2 * | 1/2020 | Wu | H01H 13/023 |
| 2001/0007301 | A1 | 7/2001 | Sato et al. | |
| 2001/0027914 | A1 | 10/2001 | Hsu | |
| 2014/0339064 | A1 | 11/2014 | Chang et al. | |
| 2018/0226211 | A1 | 8/2018 | Wu | |

FOREIGN PATENT DOCUMENTS

| | | |
|---|---|---|
| CN | 204332781 | 5/2015 |
| CN | 205487868 U | 8/2016 |

OTHER PUBLICATIONS

Written Opinion of the International Searching Authority for PCT/EP2018/070384, dated Oct. 23, 2018.

* cited by examiner

KEY MODULE FOR A KEYBOARD, AND KEYBOARD

TECHNICAL FIELD

The present invention relates to a key module for a keyboard and to a keyboard with at least one such key module.

BACKGROUND

In keyboards, such as ones used in connection with computers, for example, various key systems may be employed.

EP 1 612 821 A2 discloses a key switch, a keyboard and a key-switch assembling jig.

SUMMARY

Against this background, the present invention provides an improved key module for a keyboard and an improved keyboard in accordance with the main claims. Preferred embodiments are defined in the dependent claims and the subsequent description.

According to embodiments of the approach described here, a mechanical system or guiding mechanism comprising a double wing unit and elastic means coupled to the double wing unit may be provided for a key module. The guiding mechanism may be formed to effect equilateral, synchronous and free-of-play or reduced-play guidance or parallel guidance of a top part of the key module. In particular, the double unit and the elastic means, in conjunction with a switch unit, are also configured to provide a reset force with respect to actuation of the key module and a specific force-path characteristic and to make the same adjustable.

Advantageously, a very flat mechanical switch module can be provided, for example for gaming applications, high-end office applications and the like. For example, the switch module may be employed in notebooks and flat keyboards. The force-path characteristic of the key module with respect to actuation may be adjusted by the manufacturer, the customer and additionally or alternatively the user. For example, the key module may allow for customization by the user. The life of the key module may lie in the range of classic mechanical key modules, for example. In addition, key module may support uniform and economical illumination of a keycap or a top part by means of a light source or light source capable of being integrated. For example, such a key module may fulfil requirements concerning very flat construction dimensions, such as block dimensions of 1 to 4 millimeters, particularly of up to about 2 millimeters.

A key module for a keyboard is presented, wherein the key module comprises:

a first wing element and a second wing element for guiding a movement of the key module upon actuation, wherein each wing element comprises a bar, a first arm and a second arm, wherein the arms extend away from the bar, wherein a mounting portion is formed on the bar, wherein a first bearing portion for bearing the wing element is formed on the first arm, wherein a second bearing portion for bearing the wing element is formed on the second arm, wherein the first wing element and the second wing element are mechanically coupleable to each other;

at least one spring element for providing a reset force upon actuation of the key module, wherein the at least one spring element is mountable to the mounting portion of the first wing element and the mounting portion of the second wing element; and a support element for supporting the wing elements, wherein a plurality of accommodating portions for accommodating the bearing portions of the wing elements are formed in the support element.

The keyboard may be provided for a computer or the like, for example. The keyboard may comprise at least one key module. The key module may be part of a key or may represent a key. Hence, there may be provided one key module per key. The key module may also be referred to as a mechanical pushbutton. The at least one spring element may also be referred to as elastic means. The accommodating portions of the support element may be formed as bearing grooves, notches or the like. In other words, the accommodating portions of the support element may be formed to be groove-shaped, v-shaped and additionally or alternatively swallow-tailed. The support element may be integrally formed.

According to one embodiment, each wing element may comprise coupling portions for mechanically coupling the wing elements to each other. A first coupling portion may be formed at an end of the first arm of each wing element. A second coupling portion may be formed at an end of the second arm of each wing element. Such an embodiment offers the advantage that the wing elements can be coupled to each other easily, with quick and simple mounting also being enabled.

The first coupling portion and the second coupling portion may be formed differently. The first coupling portion of the first wing element may be coupleable to the second coupling portion of the second wing element. The second coupling portion of the first wing element may be coupleable to the first coupling portion of the second wing element. Hence, the first coupling portions may be formed to be complementary to the second coupling portions. Such an embodiment offers the advantage that the wing elements can be coupled to each other securely and reliably. In addition, the wing elements may be formed as same parts.

In particular, the first coupling portion may be formed as a link, and the second coupling portion may be formed as a protruding portion. Alternatively, the first coupling portion and the second coupling portion may be formed as teeth. Such an embodiment offers the advantage that mechanical decoupling can be achieved.

Also, the first wing element and the second wing element may be formed to be identical to each other. Additionally or alternatively, each wing element may be integrally formed. Additionally or alternatively, each wing element may be formed of a metal material. In particular, the wing elements may be blanked or stamped parts and additionally or alternatively same parts. Such an embodiment offers the advantage that manufacturing of the wing elements can be simplified and made cheaper. Furthermore, stability of the wing elements may be increased.

Furthermore, each wing element may comprise at least one connecting portion for connecting the wing element to a top part for the key module. The top part may comprise a keycap or may be coupleable to a keycap. The keycap may represent a part of the key visible to an operator and operable by depressing. Such an embodiment offers the advantage that a simple and secure mechanical connection between the elements and a one-piece top part or two-piece top part or between top part and keycap can be enabled.

The at least one connecting portion may be formed as an elastically deformable beam or as an elastically deformable beam with an end portion bent into a base area region of the bar. Herein, the bent end portion may be arranged between the bar of the wing element and the support element in a mounted state of the key module. Hence, support of the beam against the support element when mounting the top part, and support of the beam against the bar when dismounting the top part may be achieved. Such an embodiment offers the advantage that easy and safe mounting and dismounting of the top part to and from the wing elements can be made possible.

According to an embodiment, the support element may comprise soldering surface is or connector pins for attaching the support element to a circuit substrate of the keyboard. Additionally or alternatively, the support element may be formed of a metal material. Such an embodiment offers the advantage that direct attachment of the key module two a circuit board or the like can be enabled. Furthermore, the support element can be made robust.

Also, the support element may comprise at least one anchoring portion for anchoring a stabilizing bracket for stabilizing a top part for the key module with respect to torsional moments and bending moments. The at least one anchoring portion may be formed as an eye, a lug or the like. Such an embodiment offers the advantage that the stabilizing bracket can be mounted directly to the key module. Thus, an integrated solution for additional stabilization can be realized particularly for oblong keys.

Furthermore, the at least one spring element may be formed as a tension spring or as a compression spring. Such an embodiment offers the advantage that a reset force can be provided in a constructively simple and reliable manner adjustable by exchanging the at least one spring element. In addition, a compression spring may optionally also serve as a bending guide.

Also, there may be provided at least one cam for deforming the at least one spring element in an actuated state of the key module. Herein, the at least one cam may be formed on the support element, on a switch unit and additionally or alternatively on a top part for the key module. The upper part may comprise a keycap or may be coupleable to a keycap. The at least one cam may also be referred to as a protruding element, a tooth, a nose or the like. Such an embodiment offers the advantage that easy deformation of the at least one spring element can be achieved, wherein loss of its linear the formation behavior may lead to higher resistance to actuation force. Thus, a force-path characteristic with respect to actuation of the key module can be influenced advantageously, i.a. by way of a geometry of the at least one cam.

Moreover, the key module may comprise a switch unit. The switch unit may comprise a housing and a contact device partially arranged in the housing for establishing electrical contact upon actuation of the key module. The contact device may comprise a fixed contact piece with a first contact and a contactor with a first spring clip carrying a second contact and additionally or alternatively a second spring clip for producing an actuation sound and additionally or alternatively at least one actuation portion. The contactor may be integrally formed. The contactor may comprise either the first spring clip and at least one actuation portion or the first spring clip, the second spring clip and at least two actuation portions. The at least one actuation portion may be pressed by the top part or an auxiliary actuator. The electrical contact between the first contact and the second contact may be established in one contact point. Each contact may be formed to be elongated and additionally or alternatively may comprise a linear contact area. A contact area of the first contact and a contact area of the second contact may cross each other. Each contact area may extend obliquely with respect to a longitudinal axis of extension of spring clip. The second spring clip may comprise an actuation portion which is angled, bent or curved. The second spring clip may be formed to produce the actuation sound upon rebound against the housing. Such an embodiment offers the advantage that the electrical contact can be established in a reliable manner, wherein the force-path characteristic of actuation can be influenced by suitable design of the contact device. In addition, an actuation sound may optionally be realized in a simple way. The switch unit may enable the functions of both electric contact and acoustic feedback. This can be realized by the integrally formed contactor with the at least one spring clip.

In at least a subsection, the housing may formed of a transparent or opaque material and additionally or alternatively as at least one lens. Additionally or alternatively, the housing may comprise a receiving bay for a light source. Additionally or alternatively, at least one groove for accommodating at least a subsection of the at least one spring element in an actuated state of the key module may be formed in the housing. The at least one groove may also be referred to as a depressed portion, an oblong depression or a notch. The at least one lens may be configured to distribute light from a light source over the top part of the key module and additionally or alternatively over the keycap. The at least one lens may be configured to focus or scatter light. For example, the at least one lens may be an optical diffuser. Such an embodiment offers the advantage that illumination of the key can be achieved in a space-saving manner, and additionally or alternatively space for the key module can be saved due to the at least one spring element at least partially plunging into the groove.

Also, the contact device may comprise soldering areas or connector pins for attaching the switch unit to a circuit substrate of the keyboard. Additionally or alternatively, the contact device may be formed to establish the electric contact while producing friction between the first contact and the second contact. Such an embodiment offers the advantage that contact deterioration due to contamination by particles can be avoided.

Moreover, the key module may comprise a top part. The top part may comprise a keycap or be coupleable to a keycap. Additionally or alternatively, at least one groove for accommodating at least a subsection of the at least one spring element in an actuated state of the key module may be formed in the top part.

Furthermore, the key module may comprise a stabilizing bracket for stabilizing a top part for the key module with respect to torsional moments and bending moments. The stabilizing bracket may be anchored on the support element of the key module.

According to an embodiment, the housing may comprise an actuation opening for exposing the at least one actuation portion of the contact device. Additionally or alternatively, the housing may comprise a deflecting portion for deflecting the second spring dip contact device upon the actuation of the key module. The deflecting portion may formed obliquely inclined relative to the movement of the key module upon the actuation. The deflecting portion may be curved, slightly stepped, formed as a burl or a cam or the like. The deflecting portion may be formed to cause, upon the actuation of the key module, deflection or excursion of the second spring dip transversally or obliquely with respect to the movement of the key module upon the actuation. An angle of inclination of the deflecting portion relative to the movement of the key module upon the actuation may here be smaller than an angle of inclination of an angled or bent actuation portion of the second spring clip. Such an embodiment offers the advantage that easy and reliable actuation of the contact device can be enabled through the actuation opening. Additionally or alternatively, defined and low-friction deflection or excursion of the second spring clip can be achieved in order to cause a rebound of the second spring clip for the purpose of noise production.

Also, the key module may comprise an auxiliary actuator for actuating the contact device. The housing may comprise at least one holding portion for holding the auxiliary actuator. The auxiliary actuator may comprise at least one attaching portion for movably attaching the auxiliary actuator to the at least one holding portion of the housing. Additionally or alternatively, the auxiliary actuator may comprise at least one nose for deflecting the first spring clip and additionally or alternatively the second spring clip of the contact device upon the actuation of the key module. Using the holding portion and the attaching portion, movable attachment of the auxiliary actuator to the housing may be effected, wherein the movable attachment may be articulated or translational, for example. The second spring clip may be formed to produce the actuation sound upon rebound against the auxiliary actuator. The auxiliary actuator may comprise a nose for deflecting the first spring clip and additionally or alternatively the second spring clip or at least a first nose for deflecting the first spring clip and a second nose for deflecting the second spring clip. Such an embodiment offers the advantage that the contact device can be actuated in a robust and easy manner, wherein a variant of the contactor with one spring clip or two spring clips can be taken into account in a flexible manner in terms of construction.

Furthermore, the auxiliary actuator may comprise at least one fixing portion for fixing the auxiliary actuator to the first wing element or to the second wing element. The auxiliary actuator may be taken or moved along over the at least one fixing portion by at least one of the wing elements in at least one direction of movement upon the actuation of the key module. The at least one fixing portion may be formed as a protrusion. Such an embodiment offers the advantage that electric contact can be established and additionally or alternatively the actuation sound can be produced integrally in a reliable and robust manner upon the actuation of the key module. Furthermore, this can be achieved using a minimum amount of components and in a simple manner in terms of construction.

Furthermore, a keyboard is presented, wherein the keyboard comprises:

at least one item of an embodiment of the key module as previously mentioned; and a circuit substrate, wherein the at least one key module is arranged on the circuit substrate.

At least one key module as previously mentioned may thus be employed or used in conjunction with the keyboard. The at least one key module is directly attachable to the circuit substrate, for example by means of soldering or inserting connector pins.

The key module described may be used as a replacement for existing key modules, for example for key modules with linear guiding. Such modules are robust, reliable, durable and have a classic switch mechanism with noble metal contacts and metal reset springs. The mechanical concept allows for precise, low-buckling linear movements with long actuation paths, e.g. 3 to 4 millimeters, and counts among the classic mechanical switches. Switches having different force-path characteristics as well as linear force-path characteristics, having tactile characteristics or a perceptible pressure point or working point and having click characteristics or perceptible and audible characteristics are widespread. Embodiments of the key module described here avoided disadvantages of such existing key modules and yet have the advantages previously mentioned, as well as reduced constructive height as compared to the previously mentioned modules. For this reason, embodiments of the key module described can be employed not only for flat keyboards but also for notebooks or the like.

The key module described may also be employed as a replacement for key modules with scissor-type mechanics as parallel guiding and with a rubber dome as a switch mechanism. Key modules with a scissor-type mechanics are flat in terms of construction, in conjunction with relatively long actuation paths. The functionalities of guiding and force-path characteristic mostly are distinct so that the scissor-type mechanics takes over the function of guiding or parallel guiding, and a rubber dome or snap disc forms a switch mechanism and is responsible for the specific force-path characteristic. In contrast to the scissor-type mechanics with numerous, partly unstable levers with many injuries, e.g. six hinges and four links, according to embodiments of the approach described here, for example, the parallel guiding can be made stable and precise, stiffness against tilting can be provided and durability can be increased. Furthermore, noise during actuation can be minimized. According to embodiments, also a force-path characteristic and reliability which are stable over the life of the module can be achieved, in contrast to some rubber domes of silicone due to settlement.

Double wing mechanics or butterfly mechanics are less widespread. Either classic rubber domes with and without switching films or the metal snap discs serve as switch mechanism. As it is known from basic mechanics, the wings of the double wing mechanics are half as long as the levers of the scissor-type mechanics. Due to this, such mechanics are stiffer with respect to tilting as compared to scissor-type mechanics. With the same angularity of the levers, an actuation path is half as long as in the case of scissor-type mechanics. The wings of the mechanics of are realized by means of a living hinge as a link. However, pseudo-parallel movement may occur if only one wing is pivoted and the second wing is realized as a link. This leads to displacement of the key transversally with respect to a direction of actuation during the actuation. A snap disc may also be chosen as switch mechanism here. The double wing mechanics also take on the role of parallel guiding here, whereas the snap disc forms a switch mechanism and provides for a specific force-path characteristic as well as for reset. Hinges may cause play and may have an effect on stiffness against tilting. Key modules with the double wing mechanics are advantageous with respect to stiffness against tilting and to parallelism. Embodiments of the key module described here can avoided disadvantages as well as achieve the previously mentioned advantages and also advantages with respect to the overall actuation path.

BRIEF DESCRIPTION OF THE DRAWINGS

The present invention will be explained in greater detail on the basis of the attached drawings, wherein:

FIG. 27 in a slant top view;

DETAILED DESCRIPTION OF EXEMPLARY EMBODIMENTS

Figure 1:
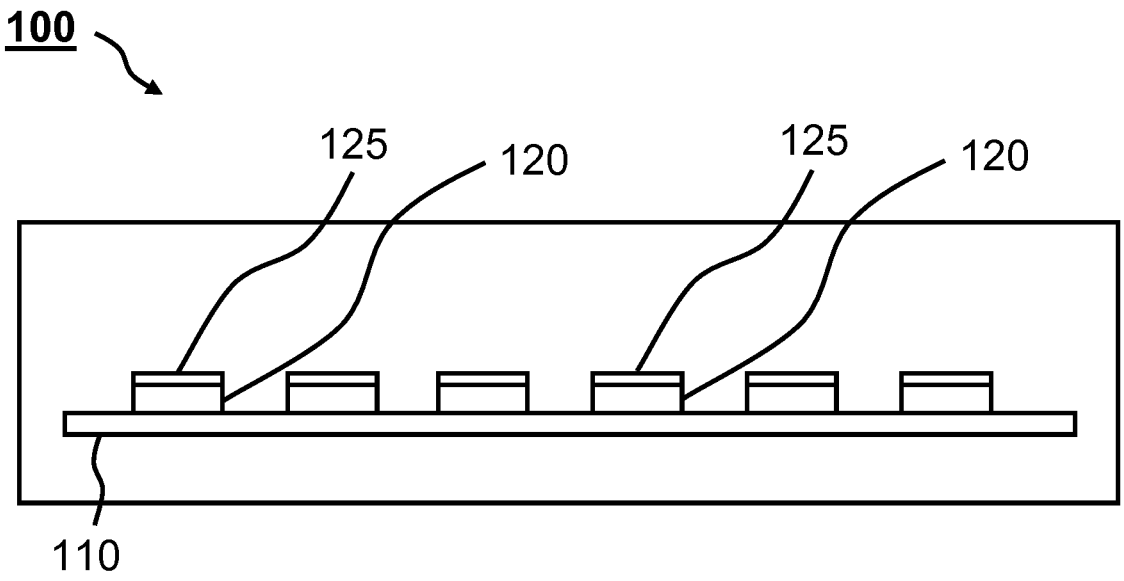
FIG. 1 shows a schematic illustration of a keyboard with key modules according to an embodiment of the present invention.

In the subsequent description of preferred embodiments of the present invention, the same or similar reference numerals shall be used for similarly acting elements depicted in the various figures, wherein repeated description of these elements shall be omitted.

FIG. 1 shows a schematic illustration of a keyboard 100 with key modules 120 according to an embodiment. For example, the keyboard 100 is part of a notebook computer, a laptop computer or the like. Alternatively, the keyboard 100 is a peripheral device for a computer, in particular.

The keyboard 100 comprises a circuit substrate 110. The circuit substrate 110 is a conductor board, circuit board or the like, for example. According to the embodiment illustrated in FIG. 1, the keyboard 100 comprises a plurality of key modules 120. The key modules 120 are arranged on the circuit substrate 110. Here, the key modules 120 are soldered onto the circuit substrate 110, for example.

Furthermore, according to the embodiment shown and described in FIG. 1, a keycap 125 is attached to each key module 120. Each keycap 125 is coupled to a respective key module 120. Each unit of key module 120 and keycap 125 represents a key of the keyboard 100. Alternatively, each key module 120 represents a key of the keyboard 100. Particularly the key modules 120 shall be explained in greater detail with reference to subsequent figures.

The keycap 125 represents a part of a key which is visible and touchable for a user of the keyboard 100. Actuation of a key module 120 is effected by pressing onto the keycap 125. Each key module 120 is configured to react to an actuation force with a force-path characteristic of resistance or a reset force. Furthermore, each key module 120 is configured to establish an electrical connection in response to actuation with a predefined actuation path, thereby performing a switching operation.

Figure 2:
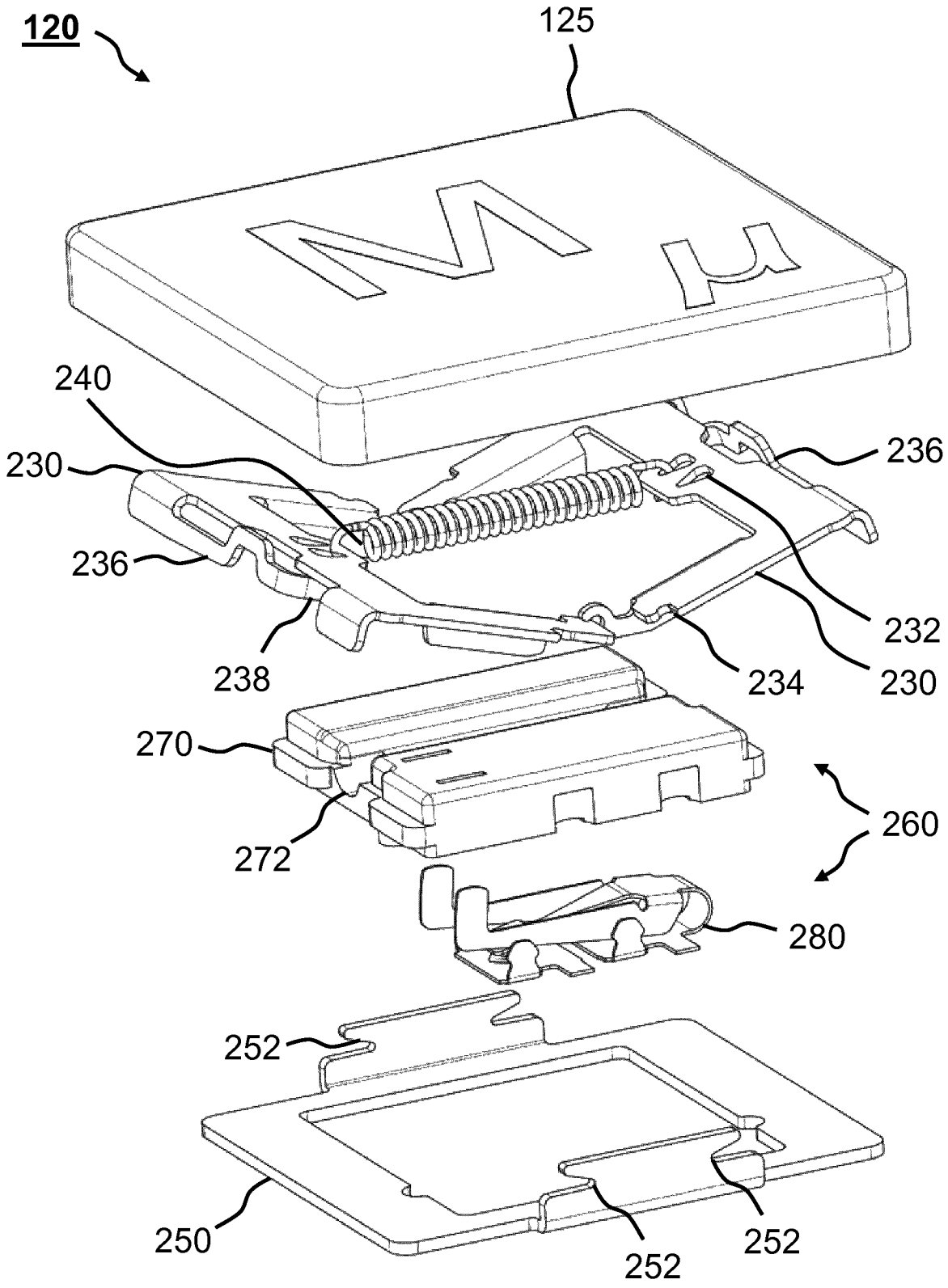
FIG. 2 shows a partially exploded view of a key module according to an embodiment of the present invention.

FIG. 2 shows a partially exploded view of a key module 120 according to an embodiment. The key module 120 here corresponds to or is similar to the key module from FIG. 1. According to the embodiment illustrated in FIG. 2, the key module 120 also comprises the keycap 125. Alternatively, the keycap 125 is provided separately from the key module 120 and is coupleable thereto. In a state in which the keycap 120 is mounted to the key module 120, the key module 120 and the keycap 125 represent a key. The keycap 125 represents a top part of the key module 120 or for the key module 120. At least one alphanumeric character or special character is printed on the keycap 125.

The key module 120 comprises a first wing element 230 and a second wing element 230 for guiding a movement of the key module 120 upon actuation by a user. The two wing elements 230 are coupled to each other mechanically. In the illustration of FIG. 2, the wing elements 230 are shown in a non-actuated state of the key module 120. In the non-actuated state, the wing elements 230 coupled to each other mechanically have an obtuse resting angle between each other. In an actuated state of the key module 120, the wing elements 230 coupled to each other have an opening angle greater than the resting angle between each other. The opening angle may also be 180 degrees. A difference between the resting angle and the opening angle may, for example, line a range from about 12 degrees to 18 degrees.

Each wing element 230 comprises a bar, a first arm and a second arm. The arms extend away from the bar. In particular, the arms extend away from the bar at right angles. Also, the arms extend in parallel with respect to each other within a tolerance range, for example. Alternatively, the arms may also extend obliquely with respect to each other. According to the embodiment illustrated in FIG. 2, the first wing element 230 and the second wing element 230 are formed to be identical with each other. In addition, each wing element 230 is integrally formed here. For example, each wing element 230 is also formed of a metal material. It will be explained in greater detail with reference to subsequent figures how the wing elements 230 are formed and coupled to each other.

According to the embodiment shown and described in FIG. 2, each of the wing elements 230 comprises two mounting portions 232 for mounting a spring element and two bearing portions 234 for bearing the wing element 230, for example. The mounting portions 232 are formed on the bar of the wing element 230. The mounting portions 232 are formed as through-holes, particularly as rounded triangular through-holes, in the wing element 230. The bearing portions 234 are formed on the arms of the wing element 230. A first bearing portion 234 is formed on the first arm, and a second bearing portion 234 is formed on the second arm. The bearing portions 234 are formed as ledges, steps or noses in outside edges of the arms of the wing element 230.

Each wing element 230 also comprises at least one connecting portion 236 for connecting the wing element 230 to a top part for the key module 120. Here, the top part comprises the keycap 125. According to the embodiment illustrated in FIG. 2, each wing element 230 comprises one connecting portion 236, for example. The connecting portion 236 is formed on the bar of the wing element 230. Here, the connecting portion 236 is formed as an elastically deformable beam. According to the embodiment shown and described in FIG. 2, the connecting portion 236 formed as an elastically deformable beam comprises an end portion 238, which is bent into a base area region of the bar. The keycap is connectable to the wing elements 230, and thus to the key module 120, via a snap-fit by means of the connecting portions 236.

The key module 120 further comprises at least one spring element 240 for providing a reset force upon the actuation of the key module 120. According to the embodiment illustrated in FIG. 2, the key module 120 comprises one spring element 240, for example. The spring element 240 is mounted to one of the mounting portions 232 of the first wing element 230 and to one of the mounting portions 232 of the second wing element 230. Here, the spring element 240 is a tension spring.

The key module 120 also comprises a support element 250 for supporting the wing elements 230. The support element 250 is also formed to support the spring element 240 and, if applicable, the keycap 125 when they are attached to the wing elements 230. For example, the support element 250 is formed of a metal material. The support element 250 comprises a plurality of accommodating portions 252 for accommodating the bearing portions 234 of the wing elements 230. According to the embodiment shown and described in FIG. 2, the support element 250 here comprises four accommodating portions 252. The accommodating portions 252 are formed as bearing grooves in the support element 250. In other words, the accommodating portions 252 are formed to be groove-shaped, v-shaped or swallow-tailed. The bearing portions 234 of the wing elements 230 are supported in the accommodating portions 252 in a mounted state of the key module 120. Thus, the wing elements 230 are supported on the support element 250 so as to be pivotable or tiltable in a predefinable angle range. The angle range is also definable by a shape of the accommodating portions 252.

The group of components comprising the wing elements 230 and the spring element 240 may also be referred to as guiding mechanism. Thus, the support element 250 is formed to support at least the guiding mechanism.

Moreover, the key module 120 comprises a switch unit 260. The switch unit 260 comprises a housing 270 and a contact device 280. The contact device 280 is at least partially arranged in the housing 270. In other words, the housing 270 is formed to accommodate at least a subsection of the contact device 280. According to the embodiment shown in FIG. 2, for example only one groove 272 four accommodating at least a subsection of the spring element 240 in an actuated state of the key module 120 formed in the housing 270. The contact device 280 is configured to establish electric contact in the course of actuation of the key module 120. The contact device 280 can be pressed or deformed by the keycap 125, for example, in order to effect the establishment of the electric contact. The switch unit 260 shall be explained in greater detail with reference to subsequent figures.

Figure 3:
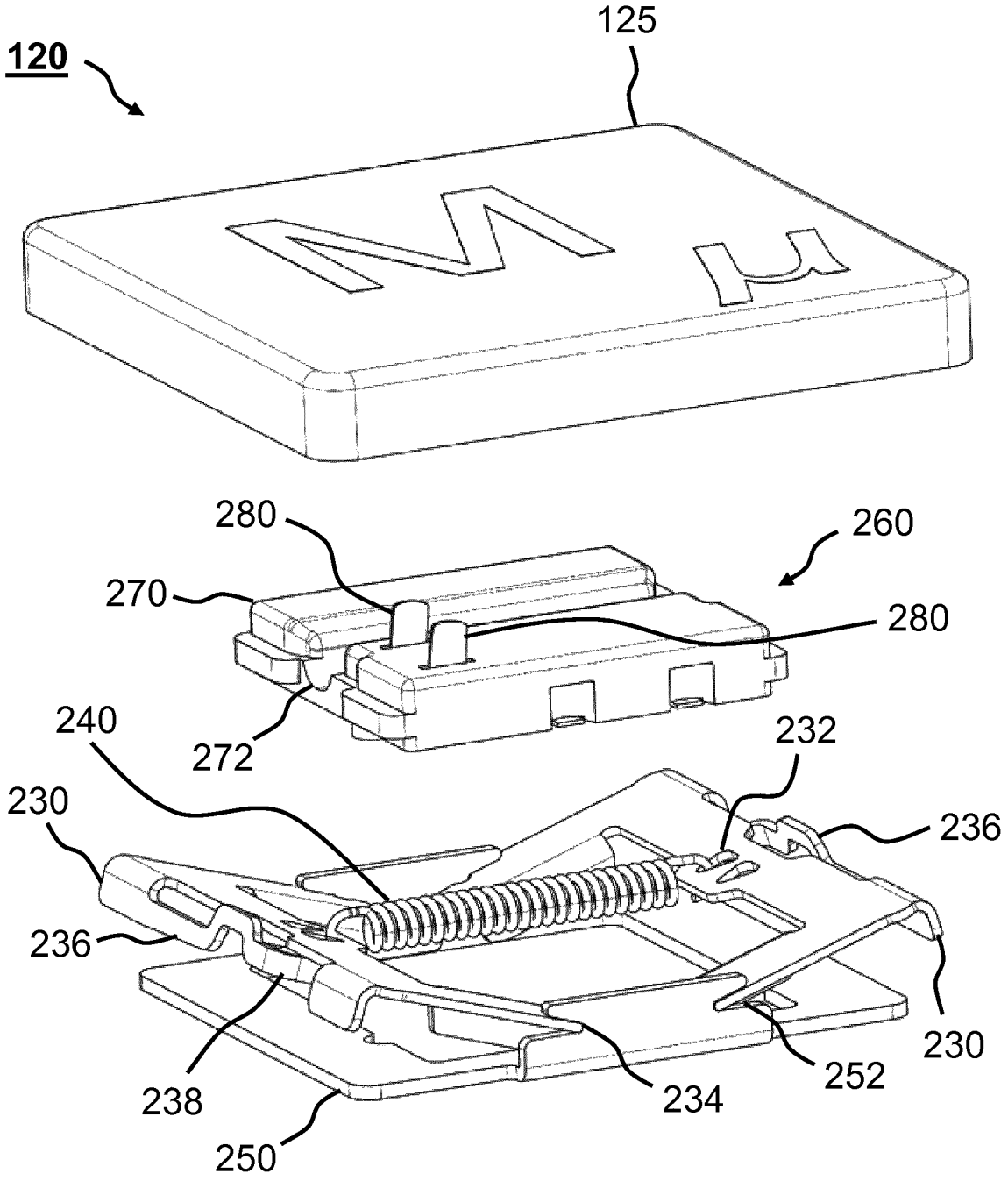
FIG. 3 shows a partially exploded view of the key module from FIG. 2 in a partially assembled state.

FIG. 3 shows a partially exploded view of the key module 120 from FIG. 2 in a partially assembled state. FIG. 3 shows the key module 120 in a state further assembled as compared to FIG. 2. Here, the switch unit 260 is shown in an assembled state, wherein the contact device 280 is partially accommodated in the housing 270. Furthermore, the wing elements 230 are supported on the support element 250. The bearing portions 234 of the wing elements 230 are arranged in the accommodating portions 252 of the support element 250.

Figure 4:
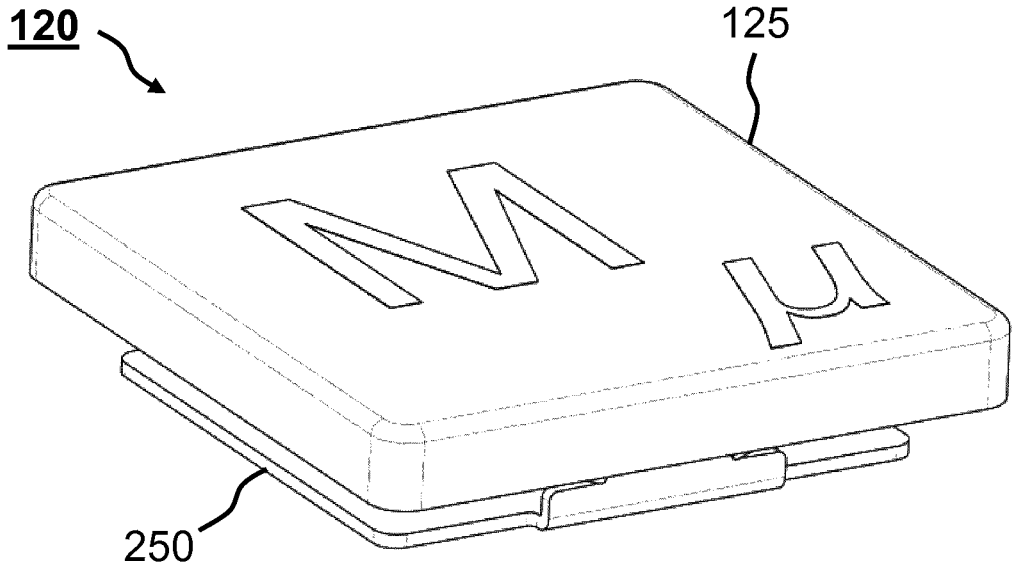
FIG. 4 shows a slant top view onto the key module from FIG. 2 or FIG. 3 in an assembled state.

FIG. 4 shows a slant top view onto the key module 120 from FIG. 2 or FIG. 3 in an assembled state. Due to the perspective in the illustration of FIG. 4, the keycap 125 and the support element 250 are visible here of the key module 120. In the assembled state of the key module 120, the keycap 125 is connected to the wing elements, and the switch unit is arranged to be surrounded by the bars and arms of the wing elements.

Figure 5:
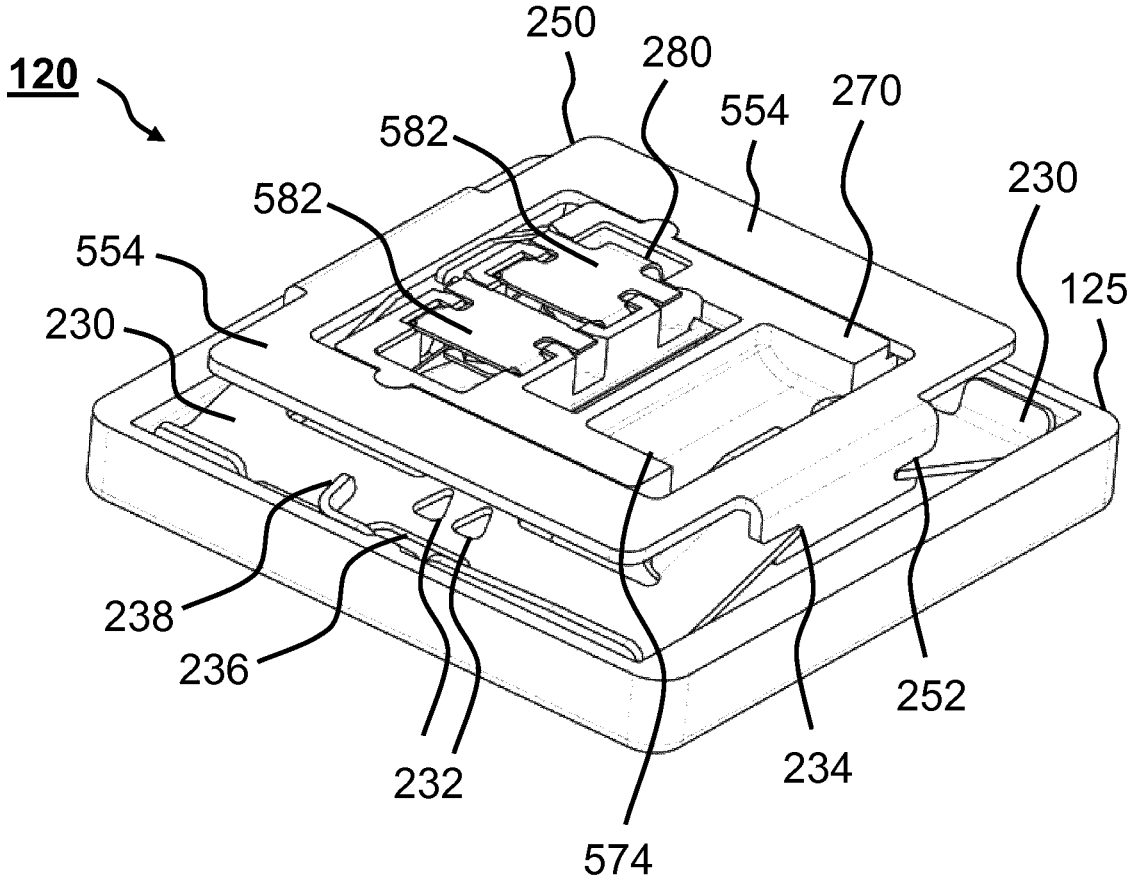
FIG. 5 shows a slant bottom view of the key module from FIG. 4.

FIG. 5 shows a slant bottom view of the key module 120 from FIG. 4. The keycap 125, the wing elements 230 with two of the four mounting portions 232, two of the four bearing portions 234 and one of the two connecting portions 236 with the bent end portion 238 are shown of the key module 120 here. Furthermore, the support element 250 with two of the accommodating portions 252 and soldering surfaces 554, the housing 270 with a receiving bay 574 and the contact device 280 with soldering surfaces 582 are shown.

The soldering surfaces 554 of the support element 250 serve for attaching the support element 252 a circuit substrate of a keyboard. The soldering surfaces 582 of the contact device 280 of the switch unit serve for attaching the switch unit to the circuit substrate of the keyboard. Hence, the key module 120 can be fitted directly on the circuit substrate by soldering the soldering surfaces 554 and 582 onto the circuit substrate.

The receiving bay 574 for receiving a light source (not shown) is formed in the housing 270 of the switch unit. The light source may be a light-emitting diode for surface mounting or SMD LED (SMD=surface-mounted device; LED=light-emitting diode), for example. Furthermore, according to an embodiment, the housing 270 is formed of a transparent or opaque material, in particular a plastics material, at least in a subsection.

It can be seen in the illustration of FIG. 5 that the switch unit with the housing 270 and the contact device 280 is arranged in a constructed space surrounded by the bars and arms of the wing elements 230.

According to another embodiment, in particular as an alternative to the soldering surfaces 554 and 582, the support element and the switch unit may be attachable to the circuit substrate of the keyboard by means of connector pins (not shown).

Figure 6:
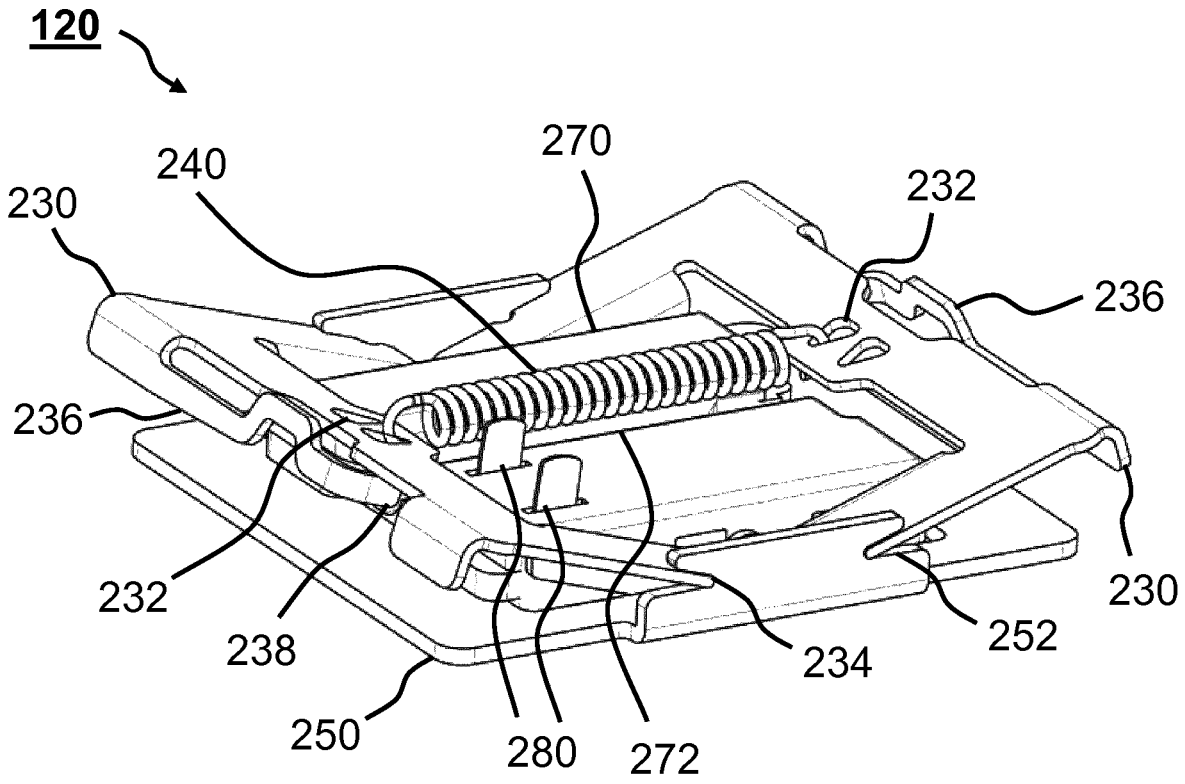
FIG. 6 shows a slant top view onto the key module from FIG. 2 to FIG. 5 in an assembled state and without keycap.

FIG. 6 shows a slant top view onto the key module 120 from FIG. 2 to FIG. 5 in an assembled state and without keycap. Thus, the illustration in FIG. 6 corresponds to the illustration from FIG. 2 or FIG. 3, except that the keycap is omitted and the key module 120 is shown in the assembled state.

Figure 7:
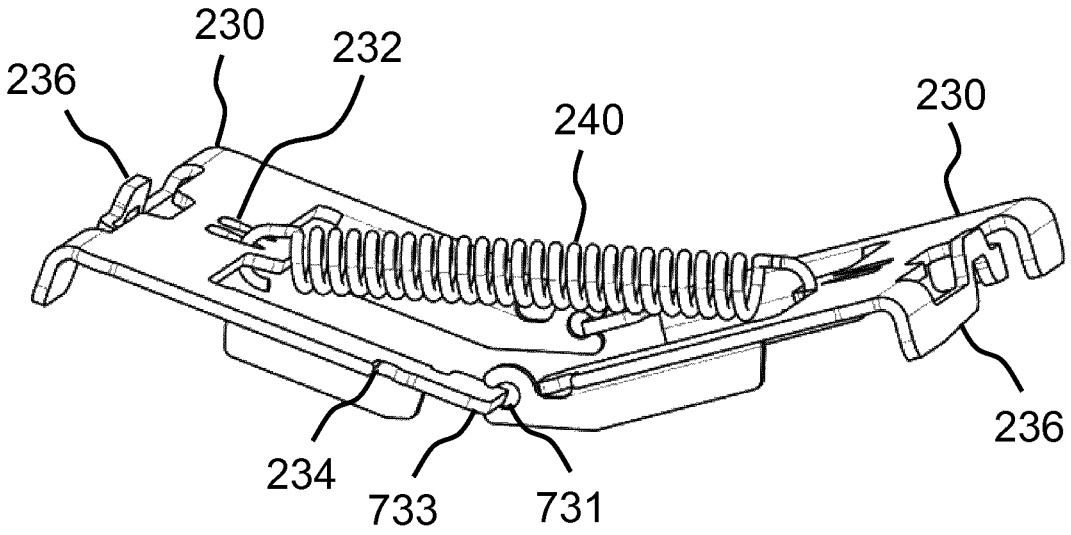
FIG. 7 shows a slant view of a subsection of the key module from FIG. 2 to FIG. 6.

FIG. 7 shows a slant view of a subsection of the key module from FIG. 2 to FIG. 6. The subsection of the key module illustrated in FIG. 7 includes the guiding mechanism. i.e. the wing elements 230 and the spring element 240. In the illustration of FIG. 7, the mounting portions 232, the bearing portions 234, the connecting portions 236 and first coupling portions 731 as well as second coupling portion 733 are shown of the wing elements 230 here.

The coupling portions 731, 733 are formed to couple the wing elements 232 each other mechanically. Each wing element 230 comprises a first coupling portion 731 and a second coupling portion 733. The first coupling portion 731 is formed at an end of the first arm of each wing element 230, and the second coupling portion 733 is formed at an end of the second arm of each wing element 230. The first coupling portion 731 and the second coupling portion 733 of each wing element 230 are formed differently. All first coupling portions 731 are formed identically, and all second coupling portions 733 are formed identically. Thus, the first coupling portion 731 of the first wing element 230 is coupleable to the second coupling portion 733 of the second wing element 230, and the second coupling portion 733 of the first wing element 230 is coupleable to the first coupling portion 731 of the second wing element 230. According to the embodiment illustrated here, the first coupling portion 731 is formed as a link, and the second coupling portion 733 is formed as a protrusion or a plate. According to another embodiment, the first coupling portion and the second coupling portion may be formed as teeth.

Figure 8:
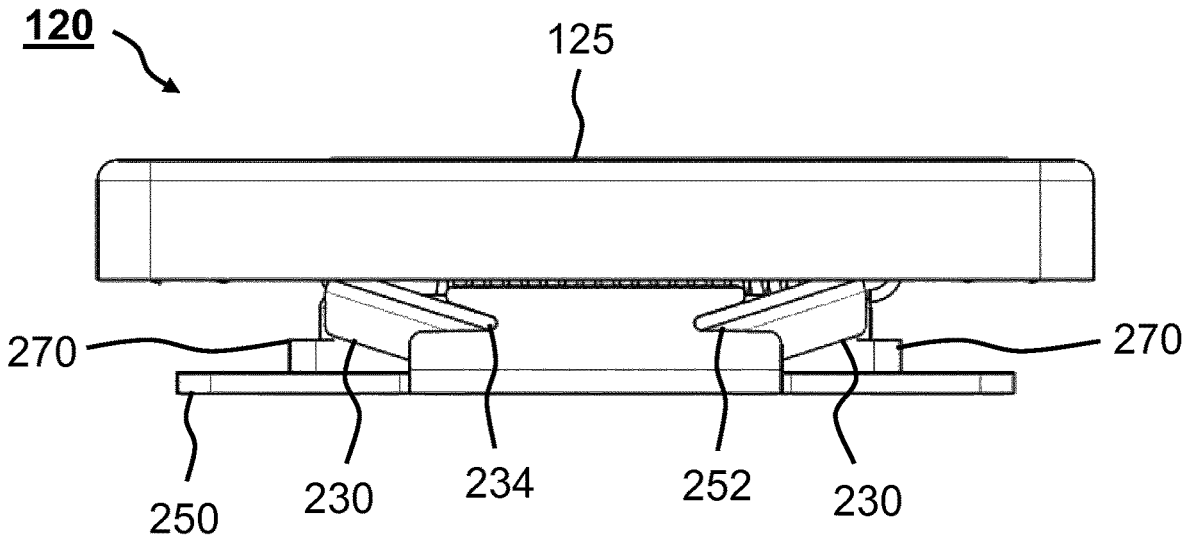
FIG. 8 shows a side view of the key module from FIG. 4 or FIG. 5.

FIG. 8 shows a side view of the key module 120 from FIG. 4 or FIG. 5. In the side view of FIG. 8 the keycap 125, the wing elements 230 with two of the bearing portions 234, the support element 250 with two of the accommodating portions 255 and the housing 270 of the switch unit are illustrated of the key module 120 here.

Figure 9:
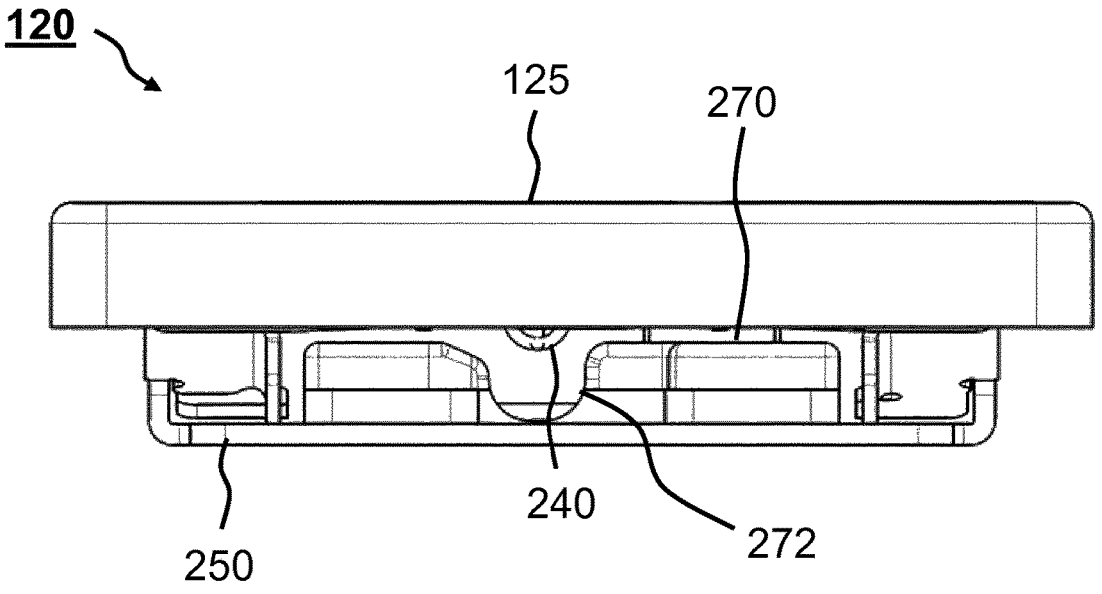
FIG. 9 shows a side view of the key module from FIG. 4 or FIG. 5.

FIG. 9 shows a side view of the key module 120 from FIG. 4 or FIG. 5. The side view illustrated in FIG. 9 corresponds to the side view from FIG. 8, except that the key module 120 in FIG. 9 is rotated by a quarter turn about an orthogonal to a surface of the keycap 125 printed with characters as compared to the illustration from FIG. 8. In the side view of FIG. 9, the keycap 125, the spring element 240, the support element 250 and the housing 270 of the switch unit with the groove 272 are illustrated of the key module 120.

Figure 10:
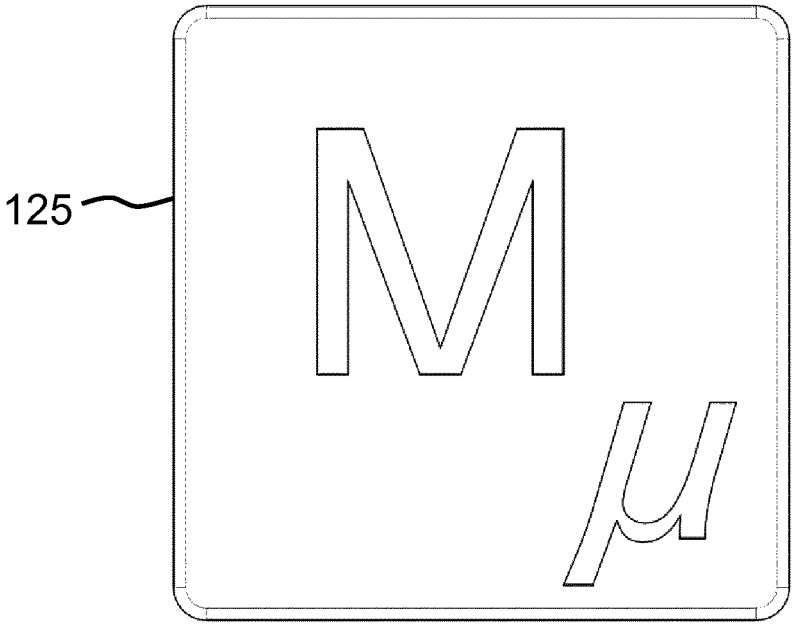
FIG. 10 shows a top view onto a keycap.

FIG. 10 shows a top view onto a keycap 125. The keycap 125 is the keycap from one of the previously described figures or a similar keycap.

Figure 11:
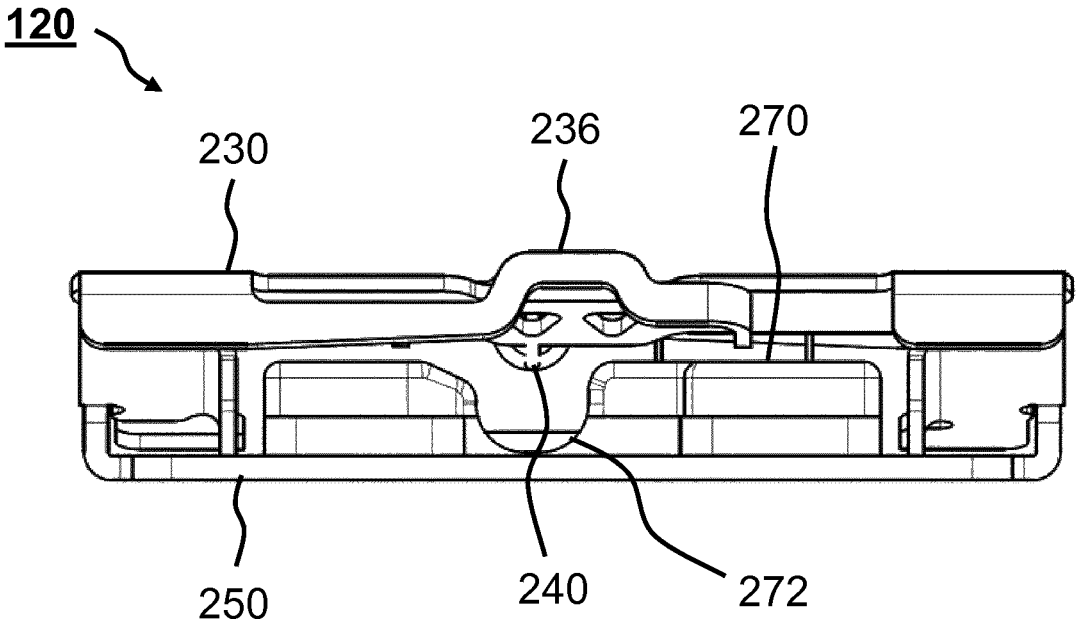
FIG. 11 shows a side view of the key module from FIG. 6.

FIG. 11 shows a side view of the key module 120 from FIG. 6. The side view shown in FIG. 11 corresponds to the side view illustrated in FIG. 9, except that the keycap omitted. Thus, in the illustration of FIG. 11, one of the wing elements 230 with the connecting portion 236, the spring element 240, the support element 250 and the housing 270 of the switch unit with the groove 272 are shown of the key module 120.

Figure 12:
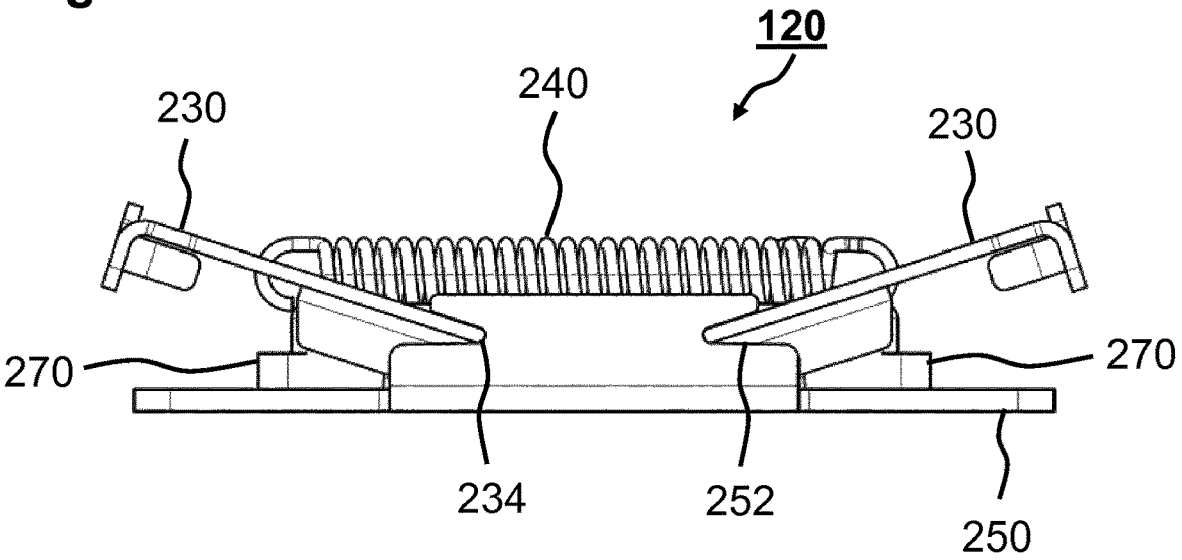
FIG. 12 shows a side view of the key module from FIG. 4 or FIG. 5.

FIG. 12 shows a side view of the key module 120 from FIG. 4 or FIG. 5. The side view shown in FIG. 12 corresponds to the side view illustrated in FIG. 8, except that the keycap is omitted. Thus, in the illustration of FIG. 12, the wing elements 230 with two of the bearing portions 234, the spring element 240, the support element 250 with two of the accommodating portions 255 and the housing 270 of the switch unit are shown of the key module 120.

Figure 13:
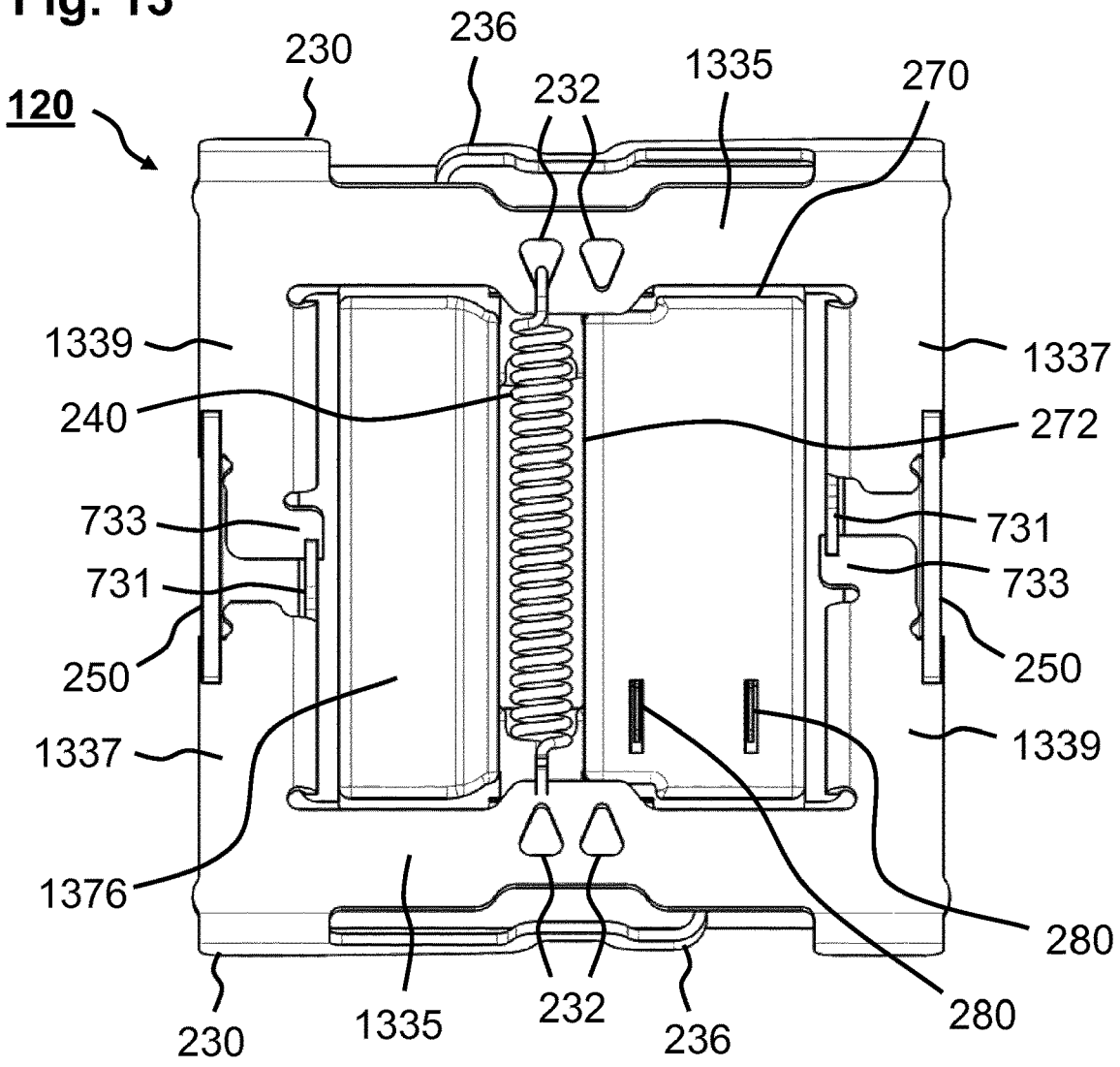
FIG. 13 shows a top view onto the key module from FIG. 6, FIG. 11 or FIG. 12.

FIG. 13 shows a top view onto the key module 120 from FIG. 6, FIG. 11 or FIG. 12. In the illustration of FIG. 13, the wing elements 230 with the mounting portions 232, the connecting portions 236 and the coupling portions 731 and 733, the spring element 240, subsections of the support element 250, the housing 270 with the groove 272 and subsections of the contact device 280 are shown of the key module 120. Bars 1335, first arms 1337 and second arms 1339 of the wing elements 230 also are explicitly designated in FIG. 13. Moreover, a subsection 1376 of the housing 270 formed as at least one lens is shown. Here, the groove 272 is arranged between the subsection 1376 and a further subsection of the housing 270 in which the contact device 280 is partially accommodated. The subsection 1376 of the housing 270 is formed to scatter and/or focus light from a light source. The light source also may be accommodated at least partly within the housing 270, according to an embodiment.

Figure 14:
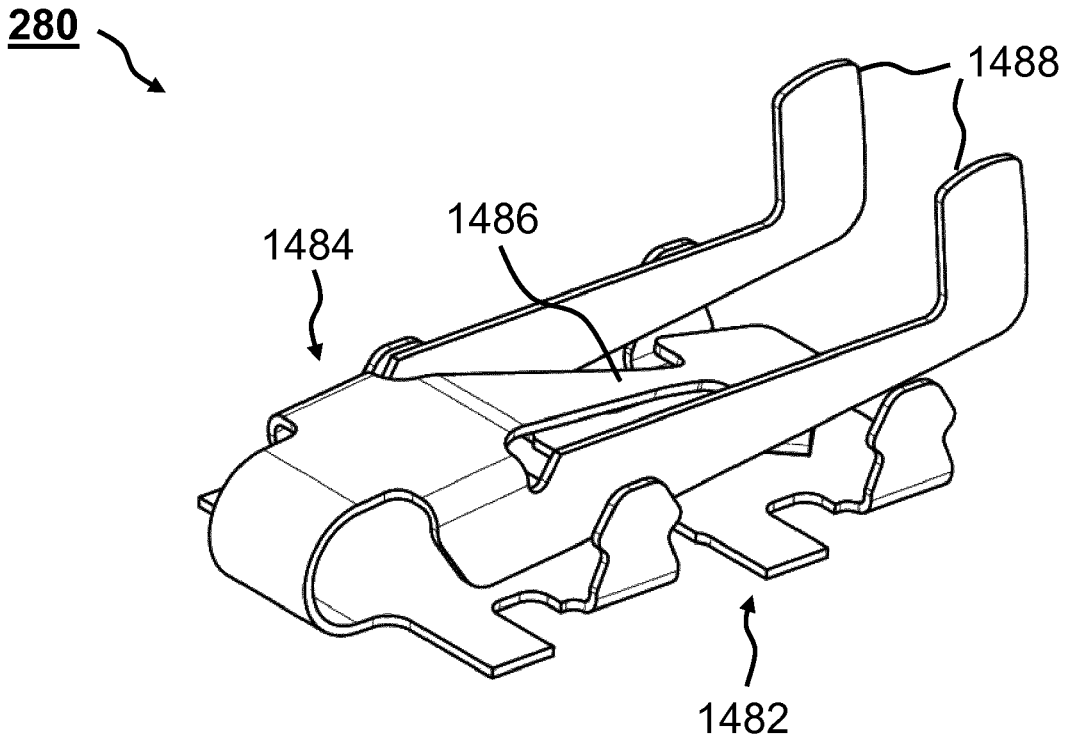
FIG. 14 shows a contact device for a key module according to an embodiment of the present invention.

FIG. 14 shows a contact device 280 for a key module according to an embodiment. The contact device 280 corresponds to or is similar to the contact device from one of the previously described figures. Hence, the contact device 280 is usable as a contact device for a switch unit of a key module of one of the previously described figures.

The contact device 280 comprises a fixed contact piece 1482 and a contactor 1484. The fixed contact piece 1482 and the contactor 1484 are electrically isolated from each other. A first contact of the contact device 280 is arranged on the fixed contact piece 1482. A second contact of the contact device 280 is arranged on the contactor 1484.

The contactor 1484 comprises a first spring clip 1486 carrying the second contact and only exemplarily two actuation portions 1488. The first spring clip 1486 is movable via the actuation portions 1488 until electric contact is established between the first contact and the second contact. The actuation portions 1488 may, for example, be actuated by a top part for the key module or of the key module upon actuation of the key module. The contactor 1484 is elastically deformable. Thus, the contactor 1484 also functions as an elastic means.

According to an embodiment, the fixed contact piece 1482 and the contactor 1484 each comprise at least one soldering surface, as shown in FIG. 5.

Figure 15:
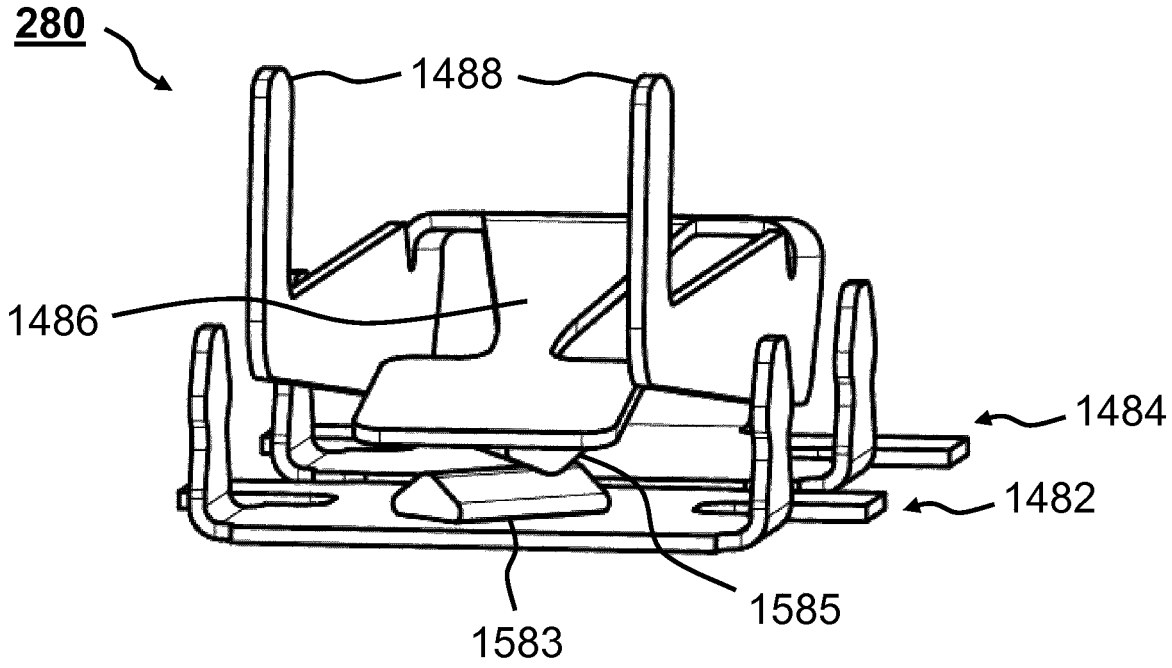
FIG. 15 shows the contact device from FIG. 14.

FIG. 15 shows the contact device 280 from FIG. 14. More specifically, FIG. 15 shows the contact device 280 of FIG. 14 from another perspective. Here, also the first contact 1583 and the second contact 1585 are shown and indicated explicitly.

The first contact 1583 comprises a linear or elongated contact region with a first axis of extension, and the second contact 1585 comprises a linear or elongated contact region with a second axis of extension. The first axis of extension and the second axis of extension cross each other, wherein electric and mechanical contact can be established between the first contact 1583 and the second contact 1585 in a punctiform contact portion.

According to the embodiment illustrated here, each axis of extension extends obliquely, in particular at an angle of 45 degrees, for example, with respect to a longitudinal axis or transversal axis of the fixed contact piece 1482 or the contactor 1484. According to the embodiment illustrated in FIG. 15, the first contact 1583 and the second contact 1585 each have a triangular sectional profile. For example, the contacts 1583 and 1585 are cut from a wire and welded on the contact device 280.

Figure 16:
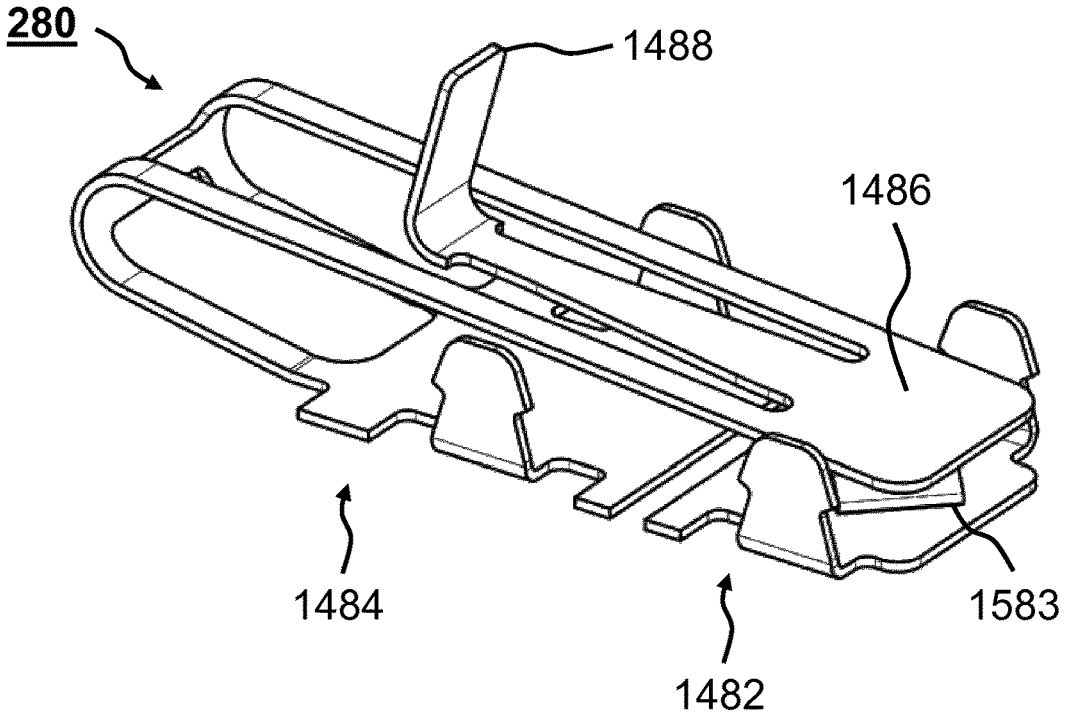
FIG. 16 shows a contact device for a key module according to an embodiment of the present invention.

FIG. 16 shows a contact device 280 for a key module according to an embodiment. The contact device 280 in FIG. 16 corresponds to the contact device from FIG. 14 or FIG. 15, except that the contactor 1484 comprises only one actuation portion 1488 and is formed differently, in particular with respect to the first spring clip 1486 and the actuation portion 1488. In other words, the contact device 280 in FIG. 16 represents a constructive variant of the contact device from FIG. 14 or FIG. 15. Thus, the contact device 280 in FIG. 16 is similar to the contact device from FIG. 14 or FIG. 15. Only the first contact 1583 of the contacts of the contact device 280 is visible due to a prospective chosen in the illustration.

Figure 17:
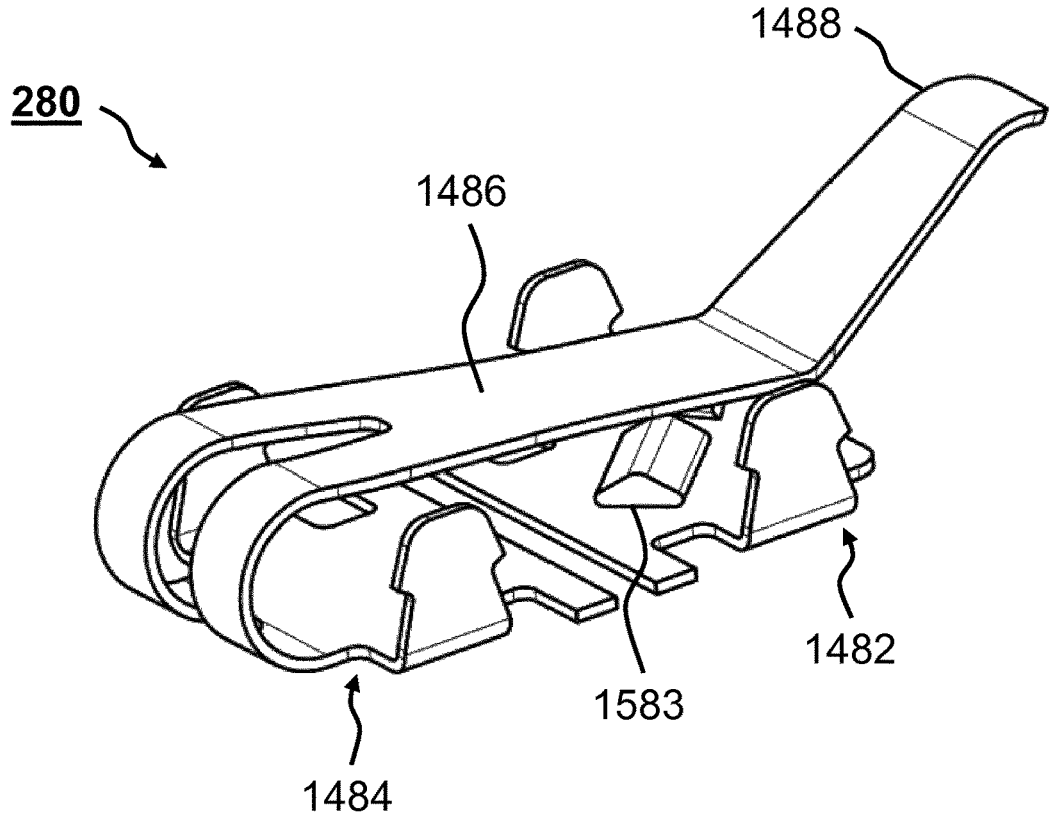
FIG. 17 shows a contact device for a key module according to an embodiment of the present invention.

FIG. 17 shows a contact device 280 for a key module according to an embodiment. The contact device 280 in FIG. 17 corresponds to the contact device from FIG. 16, except that the contactor 1484 is formed differently, in particular with respect to the first spring clip 1486 and the actuation portion 1488.

Figure 18:
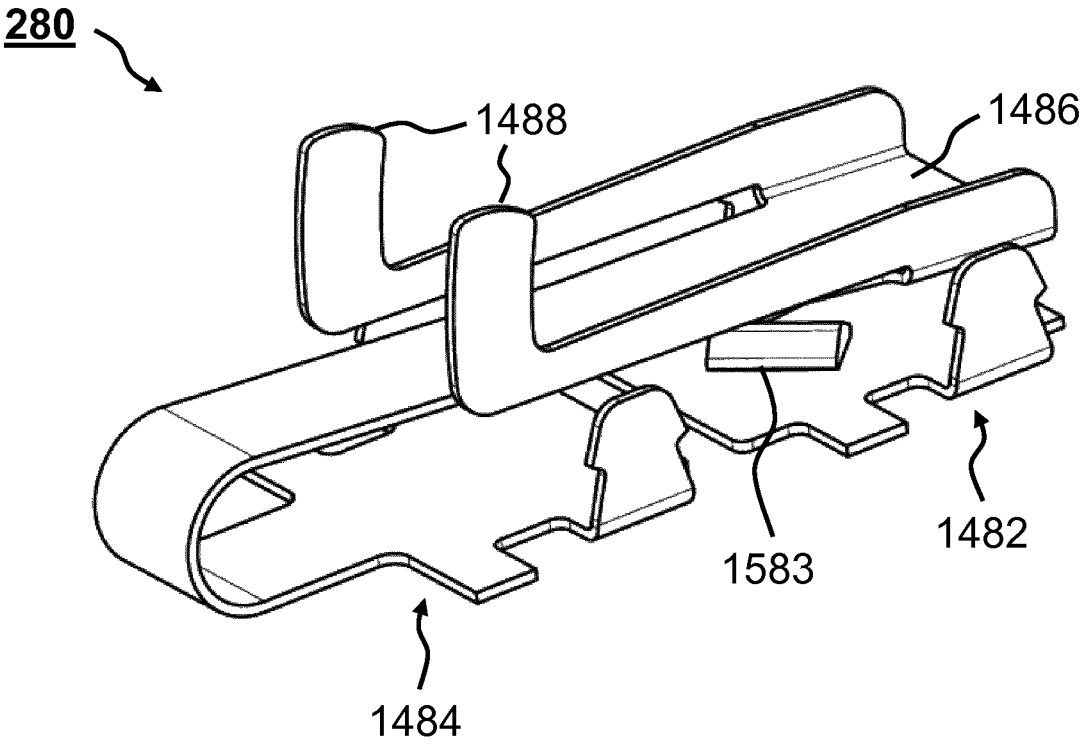
FIG. 18 shows a contact device for a key module according to an embodiment of the present invention.

FIG. 18 shows a contact device 280 for a key module according to an embodiment. The contact device 280 in FIG. 18 corresponds to the contact device from FIG. 14 or FIG. 15, except that the contactor 1484 is formed differently, in particular with respect to the first spring clip 1486 and the actuation portions 1488. Only the first contact 1583 of the contacts of the contact device 280 is visible due to a prospective chosen in the illustration.

With reference to the FIGS. 14 to 18, it is to be noted that the contact device 280, particularly the contactor 1484 with the at least one actuation portion 1488 and the first spring dip 1486, is formed to establish the electric contact while producing friction between the first contact 1583 and the second contact 1585.

Figure 19:
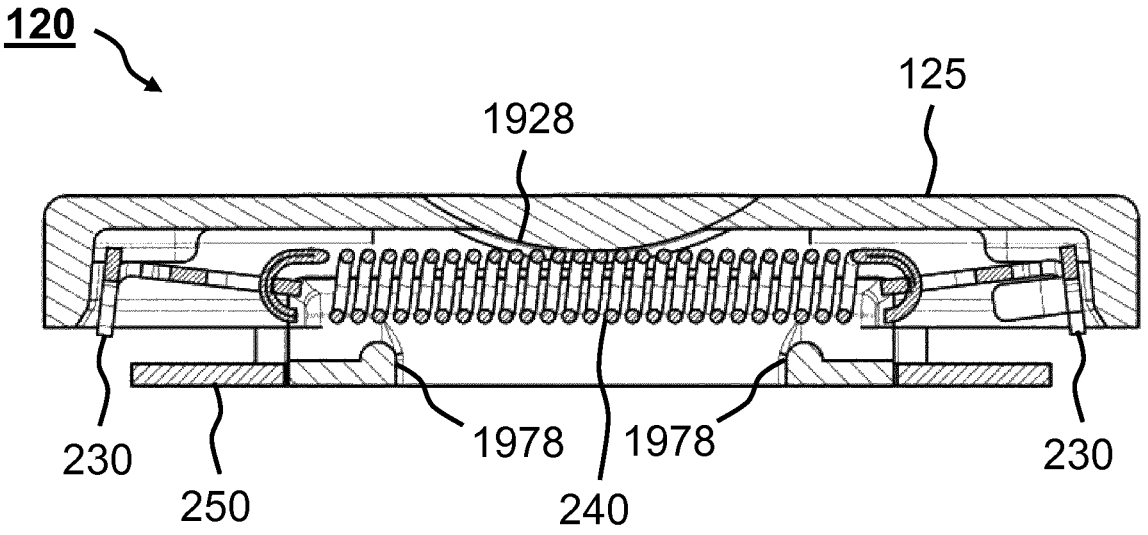
FIG. 19 shows a sectional view of a key module according to an embodiment of the present invention.

FIG. 19 shows a sectional view of a key module 120 according to an embodiment. The key module 120 in FIG. 19 is similar to the key module from FIG. 2, FIG. 3, FIG. 4, FIG. 5, FIG. 8 or FIG. 9. In FIG. 19, the keycap 125 with a top cam 1928, the wing elements 230, the spring element 240, the support element 250 and, merely by way of example, two bottom cams 1978 are illustrated of the key module 120.

The top cam 1928 is formed as a subsection of the keycap 125. More specifically, the top cam 1928 is formed as a subsection of the keycap 125 protruding toward the spring element 240. The bottom cams 1978 are formed as subsections of the housing of the switch unit. The bottom cams 1978 are formed as subsections of the housing protruding toward the spring element 240. The bottom cams 1978 are arranged in the groove of the housing, for example. Thus, the spring element 240 is arranged between the top cam 1928 and the bottom cams 1978. The cams 1928 and 1978 are formed to deform, more specifically elastically deform, the spring element 240 in an actuated state of the key module 120.

The spring element 240 is deformable by the cams 1928 and 1978 with increasing actuation path upon actuation of the key module 120. The cams 1928 and 1978 are formed and arranged to bend spring element 240. A spring force of the spring element 240 loses linearity upon deformation by the cams 1928 and 1978, wherein a reset force acting against an actuation force or a resistance acting against an actuation force increases due to the deformed spring element 240.

According to an embodiment, additionally or alternatively, at least one cam may be formed on the support element 250.

Figure 20:
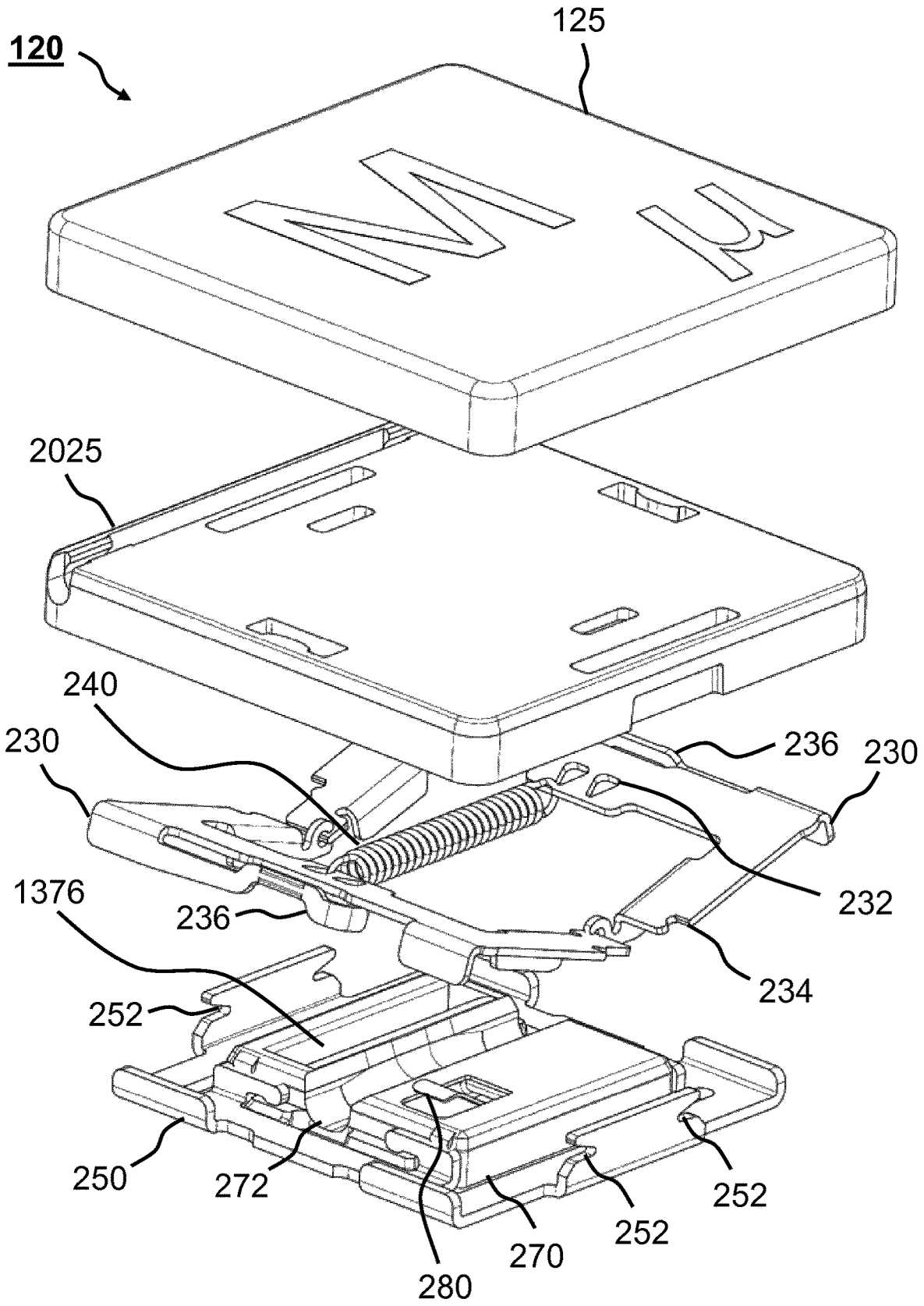
FIG. 20 shows a partially exploded view of a key module according to an embodiment of the present invention.

FIG. 20 shows a partially exploded view of a key module 120 according to an embodiment. The key module 120 corresponds to the key module from one of the previously described figures, except that the key module 120 comprises a switch unit with a different contact device 280 and housing 270 adapted there to and additionally an intermediate piece 2025, which is coupleable to the keycap 125. The keycap 125 and the intermediate piece 2025 here represent the top part for the key module 120. The intermediate piece 2025 is connectable to the wing elements 230 by means of the connecting portions 236. The keycap 125 is coupleable to the intermediate piece 2025.

Figure 21:
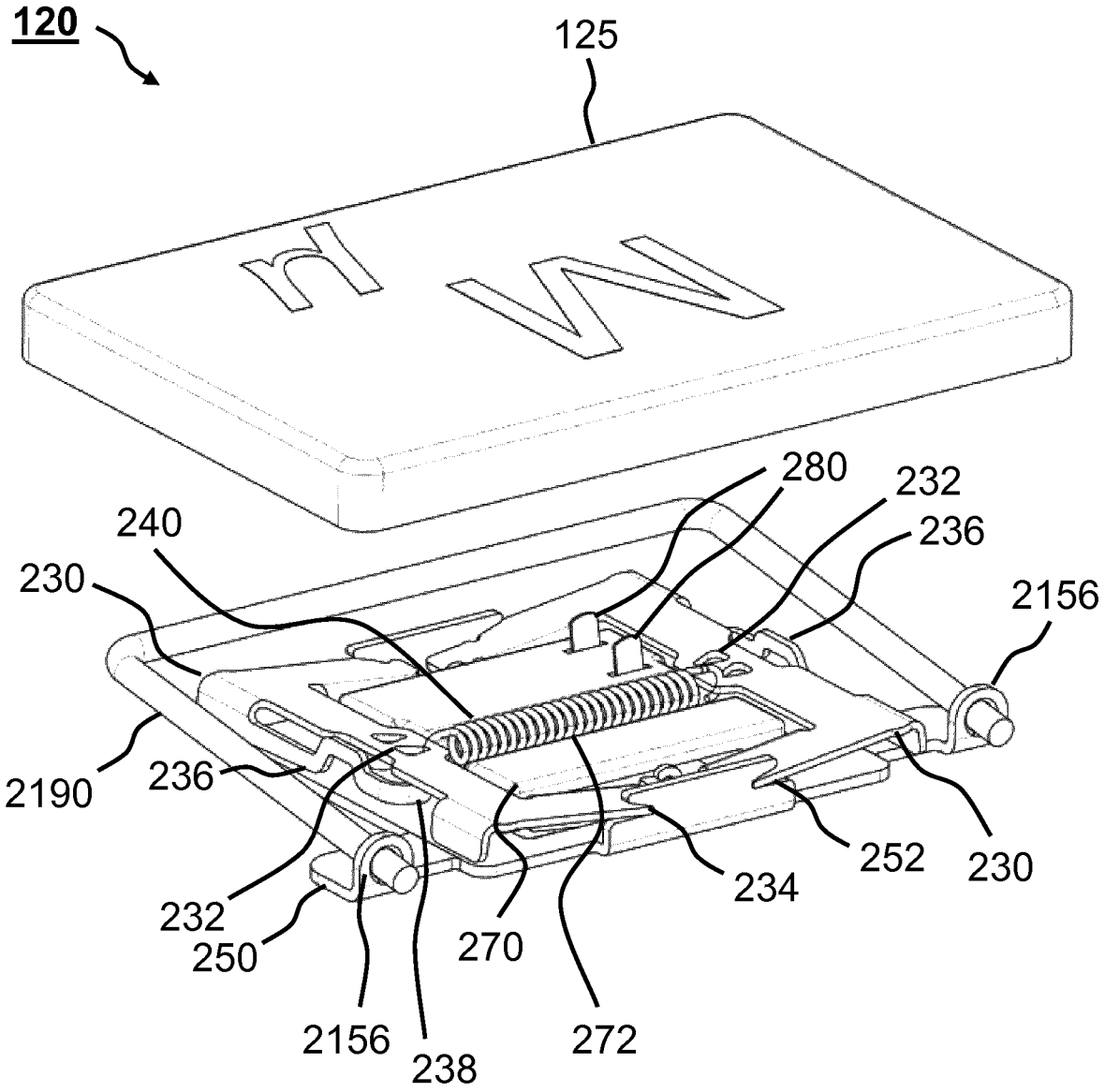
FIG. 21 shows a partially exploded view of a key module according to an embodiment of the present invention.

FIG. 21 shows a partially exploded view of a key module 120 according to an embodiment. The key module 120 corresponds to the key module from one of the FIGS. 2 to 29 or FIG. 19, except that the support element 250 comprises anchoring portion is 2156 for anchoring a stabilizing bracket 2190 for stabilizing a top part for the key module 120 with respect to torsional moments and bending moments. The anchoring portions 2156 are formed as eyes. According to the embodiment illustrated here, for example, two anchoring portions 2156 are formed on the support element 250. The top part for the key module 120 here comprises the keycap 125. The stabilizing bracket 1190 is bent in a U-shaped manner. The stabilizing bracket 1190 is anchored in the anchoring portions to 156. According to an embodiment, the key module 120 comprises the stabilizing bracket 1190.

Figure 22:
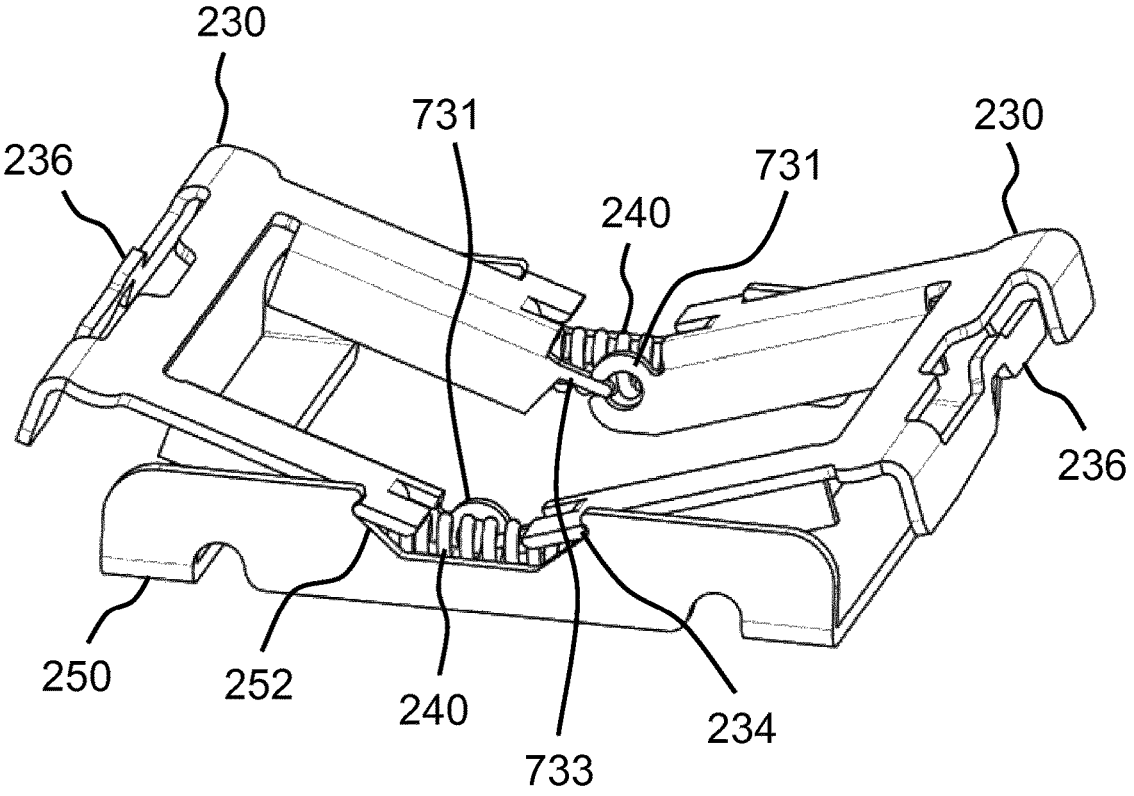
FIG. 22 shows a slant view of a subsection of a key module according to an embodiment of the present invention.

FIG. 22 shows a slant view of a subsection of a key module according to an embodiment. The subsection illustrated in FIG. 22 corresponds to the subsection shown in FIG. 7, except that two spring elements 240, which are formed as compression springs, are provided, and a support element 250 similar to the support element from one of the previously described figures is shown in the illustration, wherein the wing elements 230 and the support element 250 are partly adapted to the spring elements 240 in terms of construction.

Each of the spring elements 240 extends along a pair of coupled arms of the wing elements 230. The mounting portions of the wing elements 230 are obscured by wall portions of the support element 250 comprising the accommodating portions 252 in the illustration of FIG. 22. The wing elements 230 are coupled to each other via the coupling portions 731 and 733 and comprise the bearing portions 234 and the connecting portions 236.

Figure 23:
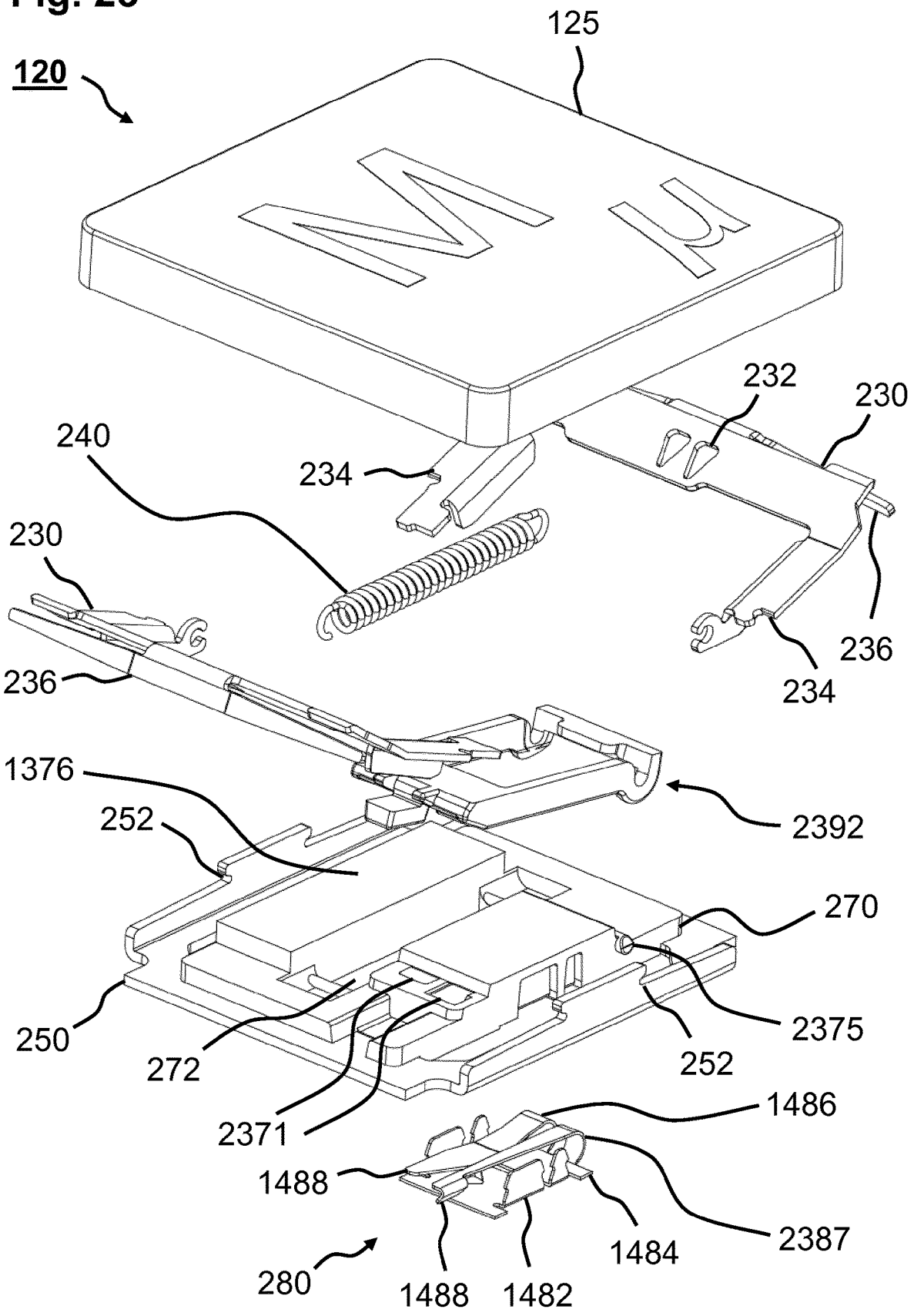
FIG. 23 shows a partially exploded view of a key module according to an embodiment of the present invention.

FIG. 23 shows a partially exploded view of a key module 120 according to an embodiment of the present invention. The key module 120 according to the embodiment of the present invention shown in FIG. 23 corresponds to the key module from one of the previously described figures, except that the housing 270 and the contact device 280 of the switch unit as well as the connecting portion 236 of each wing element 230 are formed differently, and the key module 120 additionally comprises an auxiliary actuator 2392.

The illustration in FIG. 23 is similar to the illustration from FIG. 2 or FIG. 20. In FIG. 23, in particular the keycap 125, the wing elements 230 with the mounting portions 232, the bearing portions 234 and the connecting portions 236, the spring element 240, the support element 250 with the accommodating portions 252, the housing 270 with the 272, the subsection 1376, two actuation openings 2371 and a holding portion 2375, the contact device 280 with the fixed contact piece 1482, the contactor 1484, the first spring clip 1486, two actuation portions 1488 and a second spring clip 2387, and the auxiliary actuator 2392 are shown of the key module 120.

According to the embodiment of the present invention illustrated in FIG. 23, for example two actuation openings 2371 for exposing the at least one actuation portion 1488 of the contact device 280 are formed in the housing 270. Furthermore, the housing 270 comprises at least one holding portion 2375 for holding the auxiliary actuator 2392. According to the embodiment of the present invention illustrated here, the at least one holding portion 2375 is formed as a pin. The housing 270 is arranged on the support element 250. The auxiliary actuator 2392 is formed to actuate the contact device 280. The auxiliary actuator 2392 is formed of plastics material. The contactor 1484 of the contact device 280 comprises the second spring clip 2387 for producing an actuation sound in addition to the first spring clip 1486 carrying the second contact. The first spring clip 1486 comprises an actuation portion 1488. Furthermore, the second spring clip 2387 also comprises an actuation portion 1488. The contactor 1484 is integrally formed. In particular, the contactor 1484 is formed as a stamped part or a stamped and bent part of a metal material.

With reference to subsequent figures, the housing 270, the contact device 280 and the auxiliary actuator 2392 shall be explained in greater detail.

Figure 24:
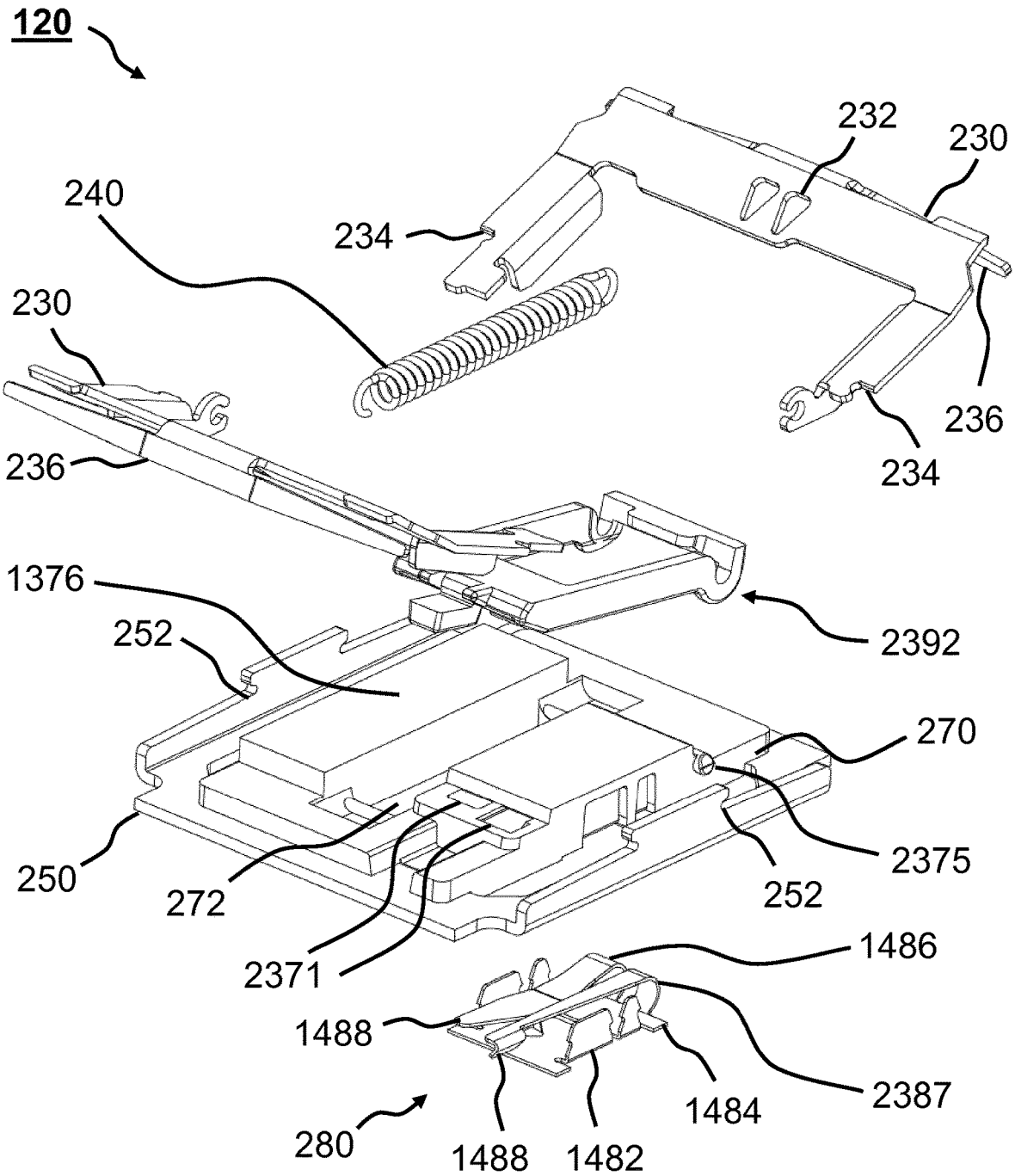
FIG. 24 shows a partially exploded view of parts of the key module from FIG. 23.

FIG. 24 shows a partially exploded view of parts of the key module 120 from FIG. 23. The illustration in FIG. 24 corresponds to the illustration of FIG. 23, except that the keycap is omitted in the illustration.

Figure 25:
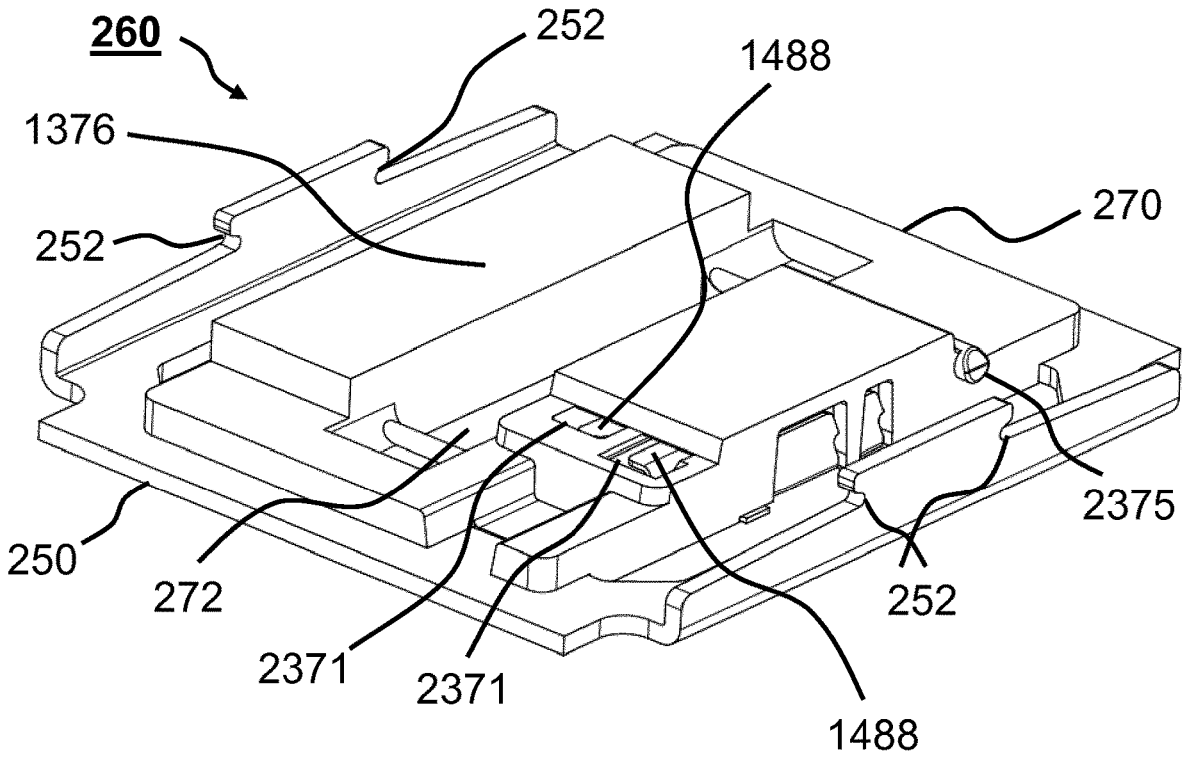
FIG. 25 shows a slant top view onto the switch unit and the support element from FIG. 23 or FIG. 24 in a partially assembled state.

FIG. 25 shows a slant top view onto the switch unit 260 and the support element 250 from FIG. 23 or FIG. 24 in a partly assembled state. The contact device is partially accommodated in the housing 270. The actuation portions 1488 of the contact device are visible through the actuation openings 2371 of the housing 270.

Figure 26:
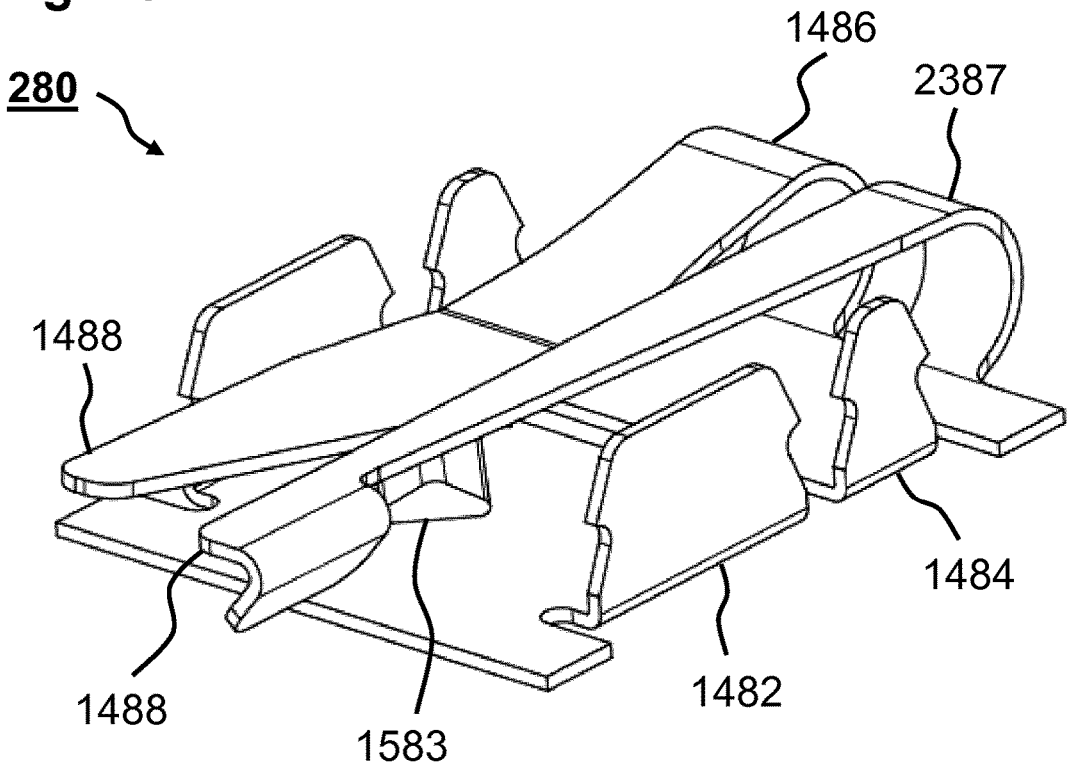
FIG. 26 shows the contact device from FIG. 23, FIG. 24 or FIG. 25.

FIG. 26 shows the contact device 280 from FIG. 23, FIG. 24 or FIG. 25. Herein, the first contact 1583 arranged on the fixed contact piece 1482 is indicated explicitly. The first spring clip 1486 and the second spring clip 2187 extend alongside each other and across the fixed contact piece 1482. What can also be seen more clearly in the illustration of FIG. 26 is that the first spring clip 1486 is tapered in the actuation portion 1488. On a side facing away from the first spring clip 1486, the actuation portion 1488 of the second spring clip 2387 comprises a kink at which the actuation portion 1488 is bent toward the fixed contact piece 1482 and the first spring clip 1486.

Figure 27:
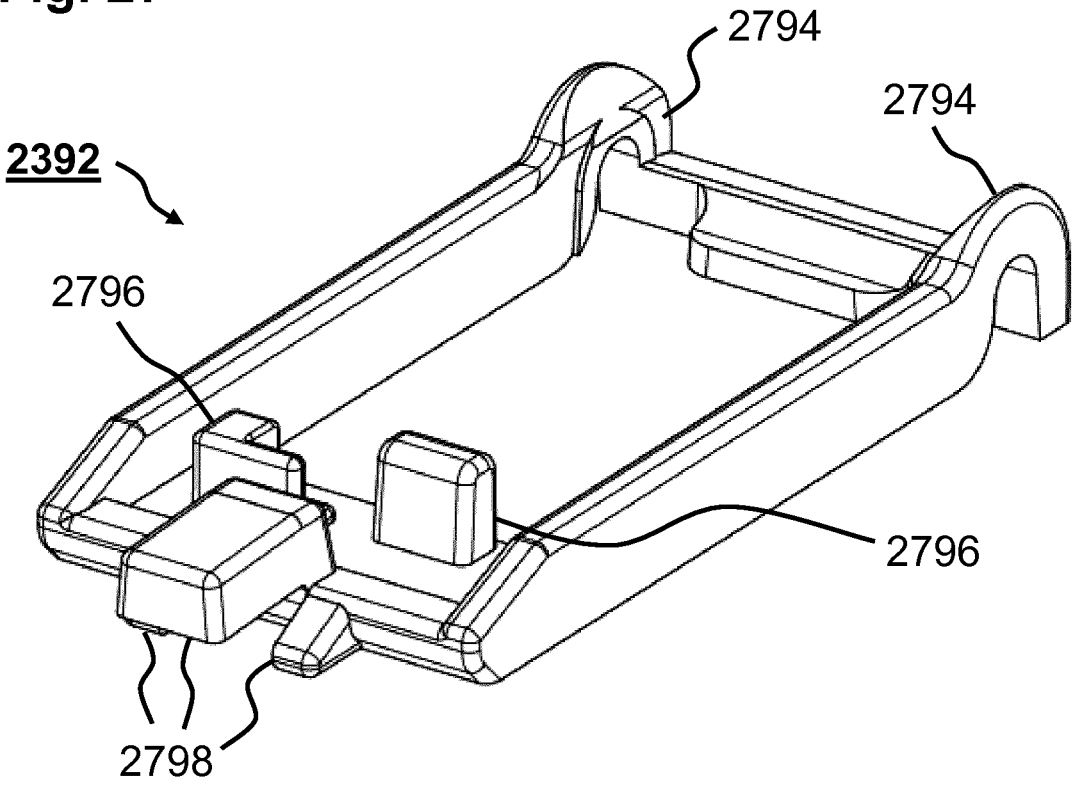
FIG. 27 shows the auxiliary actuator from FIG. 23 or FIG. 24 in a slant bottom view.

FIG. 27 shows the auxiliary actuator 2392 from FIG. 23 or FIG. 24 in a slant bottom view. According to the embodiment of the present invention illustrated here, the auxiliary actuator 2392 comprises two attaching portions 2794, two noses 2796 and three fixing portions 2798. The auxiliary actuator 2392 is integrally formed, for example of plastics material.

The attaching portions 2794 are formed to allow for movably attaching the auxiliary actuator 2392 to the at least one holding portion of the housing of the switch unit. The attaching portions 2794 are arcuate or hook-shaped and are formed to accommodate the at least one holding portion by latching or snapping.

The noses 2796 are formed to deflect the first spring clip and/or the second spring clip of the contact device upon the actuation of the key module. According to another embodiment, wherein the contact device is formed differently, the auxiliary actuator 2392 may comprise only one nose 2796 and/or at least one differently formed nose 2796.

The fixing portions 2798 are formed to fix the auxiliary actuator to 392 to the first wing element or to the second wing element. The fixing portions 2798 are formed as protrusions. According to another embodiment, the auxiliary actuator 2392 may comprise a different number of fixing portions 2798 and/or differently formed fixing portions 2798.

Figure 28:
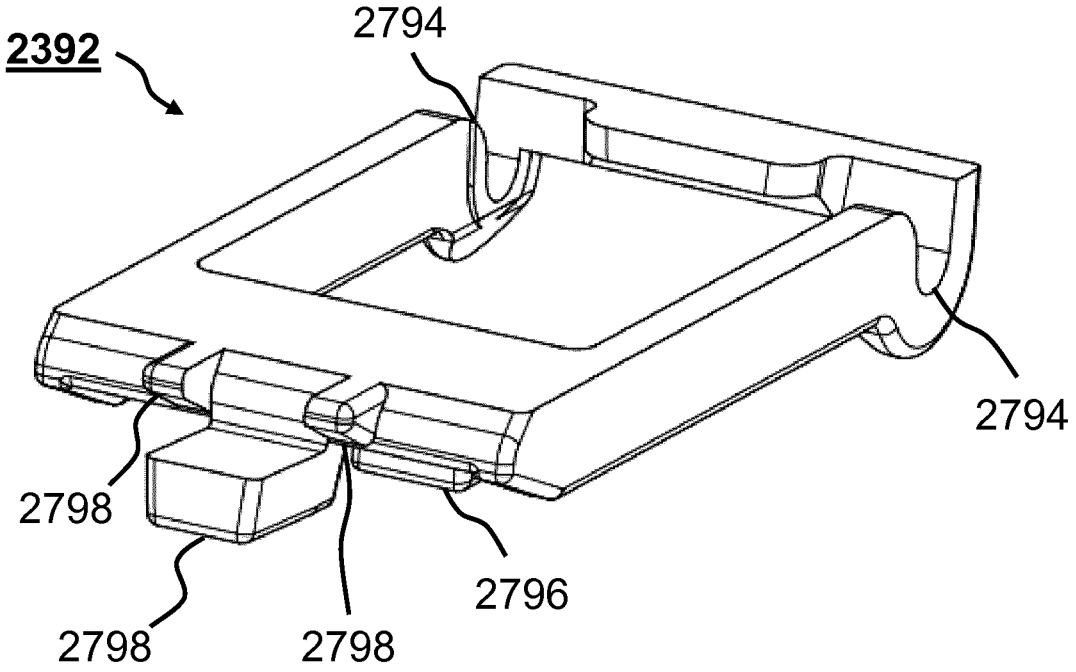
FIG. 28 shows the auxiliary actuator from FIG. 23, FIG. 24 bzw.

FIG. 28 shows the auxiliary actuator 2392 from FIG. 23, FIG. 24 or FIG. 27 in a slant top view. Due to the illustration, one of the noses 2796 is obscured by one of the fixing portions 2798. It can be seen that the fixing portions 2798 are disposed and formed to arrange the bar of one of the wing elements between one of the fixing portions 2798 and the remaining two fixing portions 2798.

Figure 29:
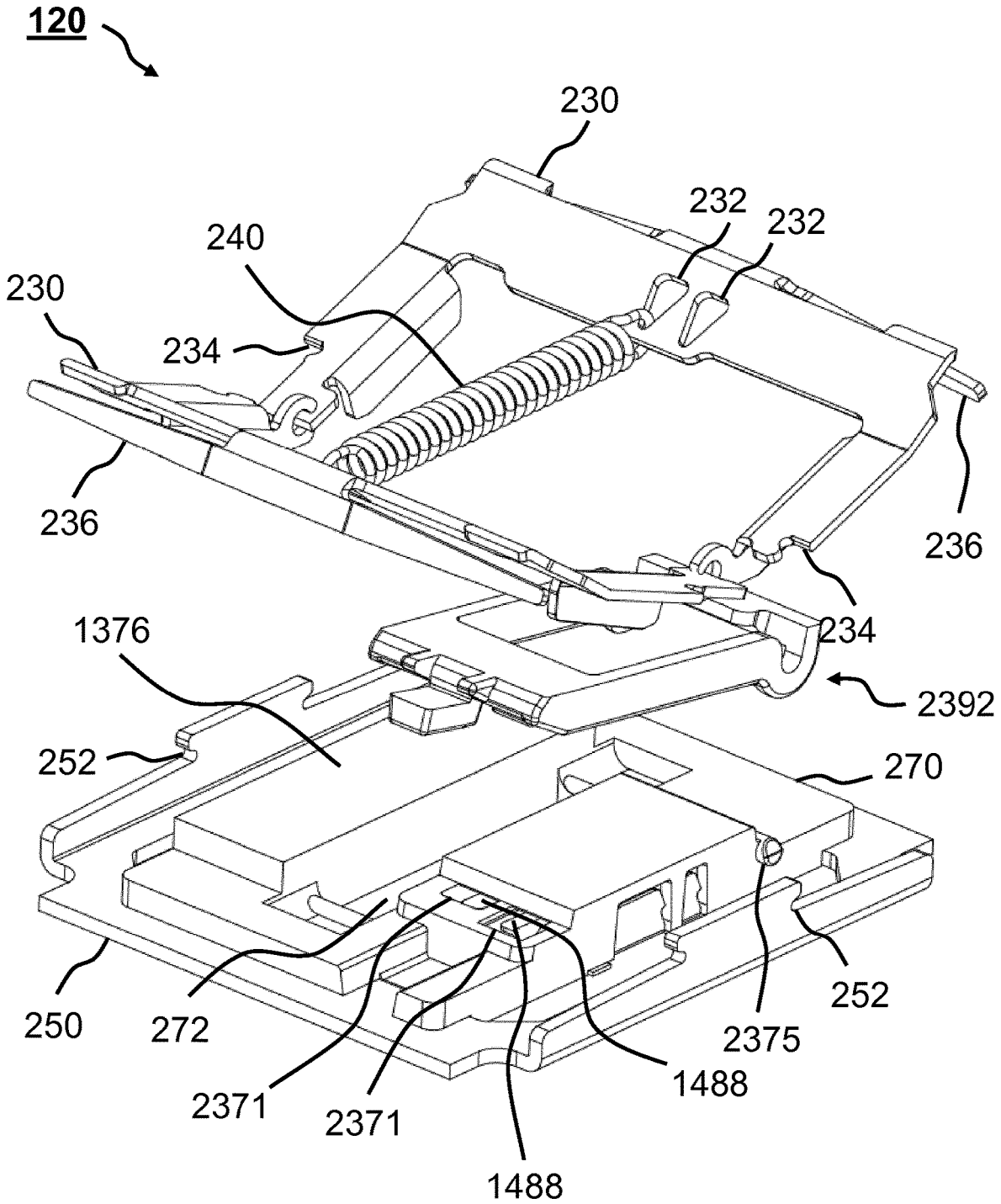
FIG. 29 shows a partially exploded view of parts of the key module from FIG. 24 in a partially assembled state.

FIG. 29 shows a partially exploded view of parts of the key module 120 from FIG. 24 in a partially assembled state. The spring element 240 is hooked into one mounting portion 232 each of the first wing element 230 and of the second wing element 230. Furthermore, the wing elements 230 are coupled to each other via their coupling portions. The switch unit and the support element 250 shown in the state of FIG. 25. Thus, the contact device is at least partially accommodated in the housing 270.

Figure 30:
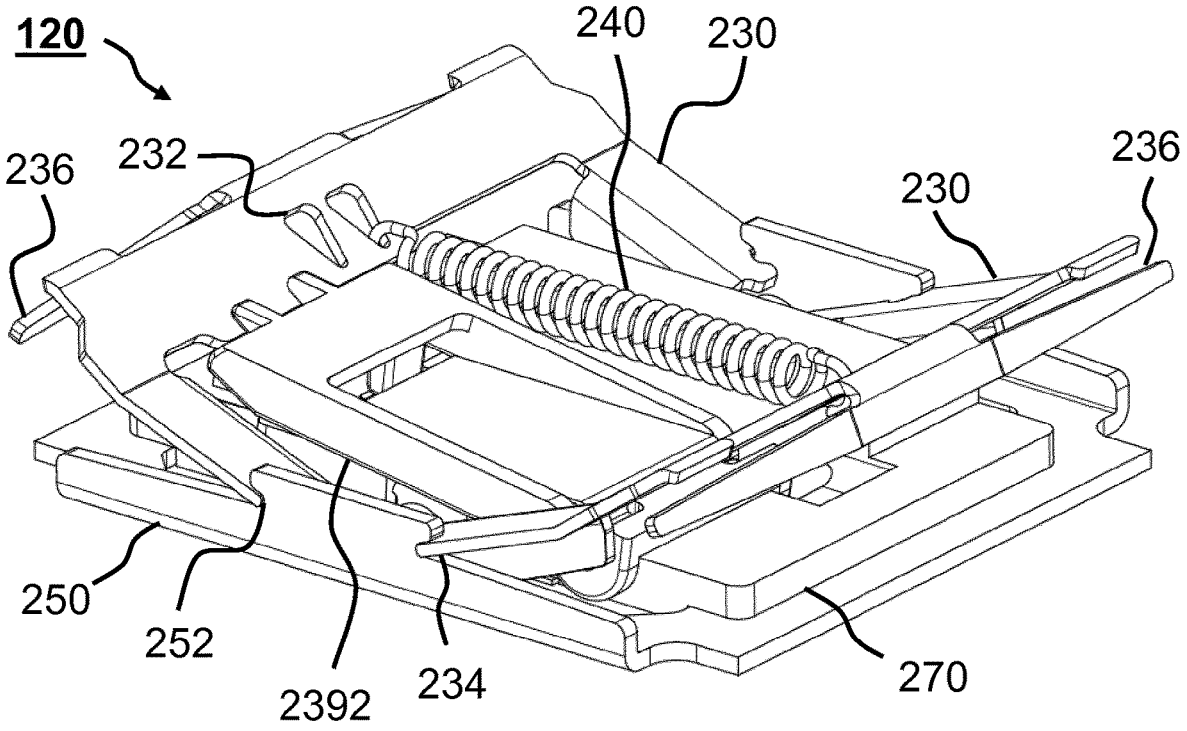
FIG. 30 shows a slant top view onto the key module from FIG. 24 or FIG. 29 in a mounted and non-actuated state.

FIG. 30 shows a slant top view onto the key module 120 from FIG. 24 or FIG. 29 in a mounted and non-actuated state. The wing elements 230 are attached to the support element 250, wherein the bearing portions 234 of the wing elements 230 are arranged in the accommodating portions 252 of the support element 250. The auxiliary actuator 2392 is attached to the housing 270 by means of its attaching portions and is fixed to one of the wing elements 230 by means of its fixing portions. A plane of extension of the auxiliary actuator 2392 is inclined relative to a plane of extension of the housing 270.

Figure 31:
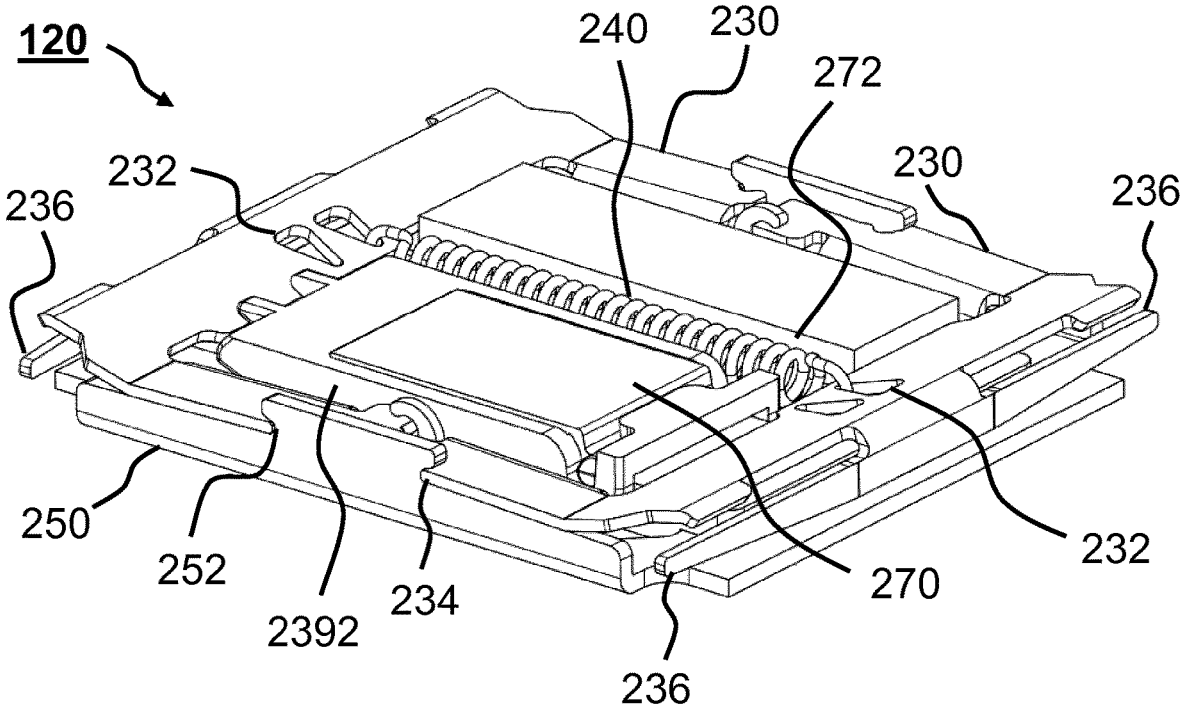
FIG. 31 shows a slant top view onto the key module from FIG. 24, FIG. 29 or FIG. 30 in a mounted and actuated state.

FIG. 31 shows a slant top view onto the key module 120 from FIG. 24, FIG. 29 or FIG. 30 in a mounted and actuated state. It can be seen that the spring element 240 is plunged into the groove 272 of the housing 270. Part of an actuation force exerted on the wing elements 230 is transferred to the contact device of the switch unit via the auxiliary actuator 2392. The plane of extension of the auxiliary actuator 2392 is oriented along the plane of extension of the housing 270 in the actuated state of the key module 120.

Figure 32:
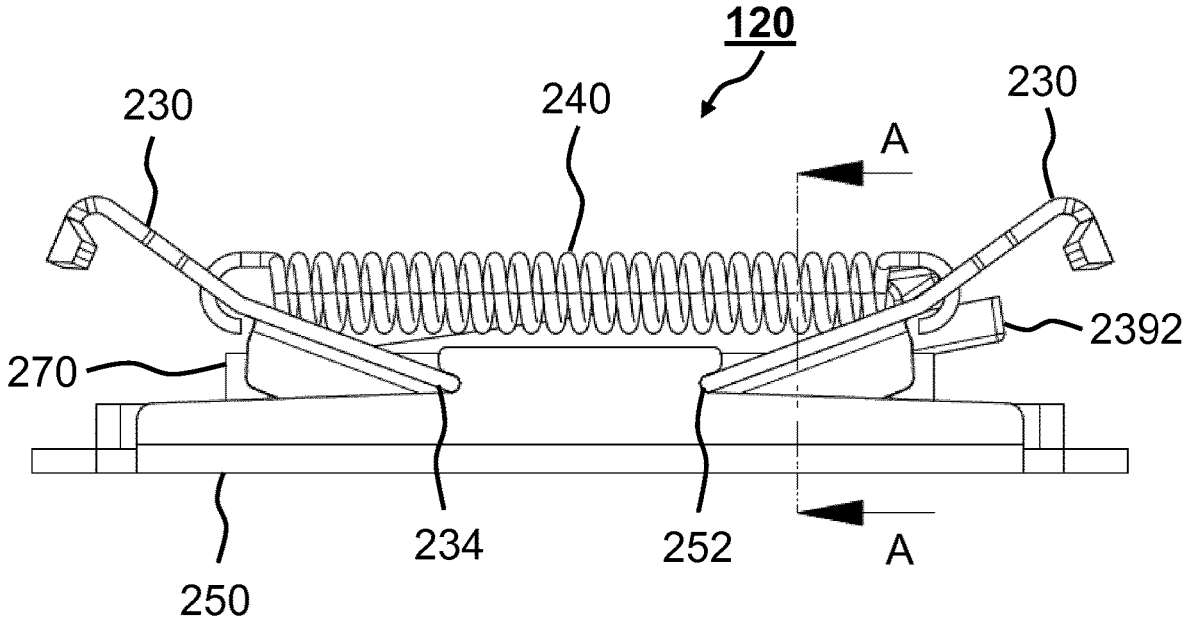
FIG. 32 shows a side view of the key module from FIG. 30.

FIG. 32 shows a side view of the key module 120 from FIG. 30. The illustration in FIG. 32 is similar to the illustration of FIG. 12. In the side view of FIG. 32, the wing elements 230 with two of the bearing portions 234, the spring element 240, the support element 250 with two of the accommodating portions 252, a subsection of the housing 270 as well as a subsection of the auxiliary actuator 2392 are shown of the key module 120. What is also depicted is a cutting line A-A for a sectional view or partially sectional view through the key module 120. The cutting line A-A extends transversally to a longitudinal axis of the spring element 240.

Figure 33:
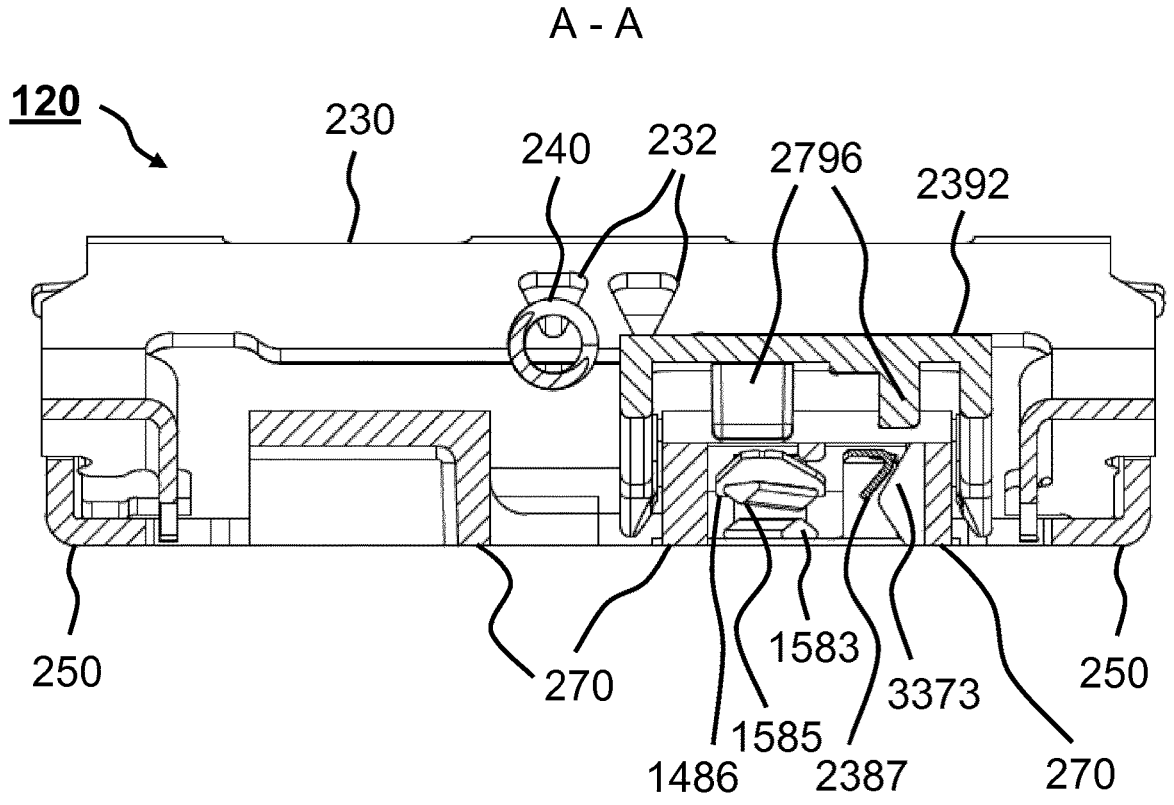
FIG. 33 shows a partially sectional view of the key module from FIG. 32.

FIG. 33 shows a partially sectional view of the key module 120 from FIG. 32 along the cutting line A-A. In the partially sectional view of FIG. 33, subsection is one of the wing elements 230 with two of the mounting portions 232, subsections of the spring element 240, subsections of the supporting element 250, subsections of the housing 270 a deflecting portion 3373, subsections of the auxiliary actuator 2392 with the two noses 2796 and subsections of the contact device with the first spring clip 1486, the second spring clip 2387, the first Kontakt 1583 and the second Kontakt 1585 are shown of the key module 120.

It can be seen that a first one of the noses 2796 of the auxiliary actuator 2392 is formed and arranged to actuate or deflect the first spring clip 1486, and thus to close the contacts 1583 and 1585. Furthermore, it can be seen that a second one of the noses 2796 of the auxiliary actuator 2392 is formed and arranged to actuate or deflect the second spring clip 2387 in order to produce an actuation sound. The deflecting portion 3373 of the housing 270 is formed to deflect the second spring clip 2387 of the contact device 280 when the key module 120 is being actuated. The deflecting portion 3373 is obliquely inclined with respect to a movement or axis of movement of the key module 120 during actuation thereof. A kink angle of the actuation portion of the second spring clip 2387 is greater than an angle of inclination of the deflecting portion 3373 relative to the axis of movement. Thus, a terminal edge of the second spring dip 2387 is spaced from the deflecting portion 3373. In this way, friction, scratching and the like between the deflecting portion 3373 and the actuation portion of the second spring dip 2387 can be minimized or prevented.

During actuation of the key module 120, there is movement of the wing elements 230, which is transferred to the first spring clip 1486 and to the second spring clip 2387 via the auxiliary actuator 2392. In the course of such an excursion movement of the first spring dip 1486, the first contact 1583 and the second contact 1585 come into contact with each other. Furthermore, in the course of such an excursion movement of the second spring clip 2387, it is deflected laterally at its actuation portion by the deflecting portion 3373. Due to the slope or inclination of the deflecting portion 3373 relative to the movement, the lateral deflection of the second spring dip 2387 increases with increasing excursion, until the actuation portion of the second spring dip 2387 slips from the nose 2796 of the auxiliary actuator 2392 actuating the same, and there is a rebound of the second spring dip 2387 against the housing 270 or the auxiliary actuator 2392, which produces the actuation sound.

Embodiments shall subsequently be summarized and described in other words with reference to the previously described figures.

In particular, double wing mechanics, which fulfils the task of parallel guidance of the key and the task of resetting and of the specific force-path characteristic, form one basis of the key module 120. The wing elements 130 of the double wing mechanics are designed as stamped parts, for example. This allows for inexpensive manufacture of the parts from high-tensile steel and thus results in advantages regarding stiffness and wear. It is also conceivable to form the parts of plastics, for example. Moreover, the wing elements 230 are designed as same parts, and two wing elements 230 are used per key module 120. The double wing mechanics are designed for an optimum actuation path of about 1.5 millimeters or the like, for example.

In order to reduce disadvantageous play, the wing elements 230 are not designed as a rotational hinge but by means of bearing notches, i.e. the accommodating portions 252, wherein a pivoting movement can be performed in a predefined angular range only. As the two wing elements 230 are tightened together by means of the at least one spring element 240 and are pressed into the accommodating portions 252, the two wing elements 230 move without play or with little play and with little noise. The wing elements 230 are connected to each other by the coupling portions 731 and 733 or also by means of links which decouple counter-rotations of both wing elements 230 occurring upon actuation of the key module 120. The accommodating portions 252, bearing portions 234, links or first coupling portion 731 and mounting portions 232 or spring mounts are arranged such that the key module 120 exhibits a decreasing force-path characteristic after an early maximum during actuation.

This means that a reset force is highest in the rest position. In the end position or completely actuated state, the reset force approaches zero. The force-path characteristic can be adjusted arbitrarily, in particular by means of the spring element 240 and the switch unit 260 as well as optionally cams 1928 and/or 1978. The intermediate piece 2025 or the keycap 125 is latched on connecting portions 236 of the wing elements 230 formed as preloaded balance springs or leaf springs by means of two catches, and thus is floatingly suspended without play. During the actuation, the top part 125 or 125 and 2025 moves uniformly, i.e. parallel to the support element 250. As stiffness of the metal wing elements 230 is high and overall play in the guiding mechanism is minimized, the top part 125 four 125 and 2025 or top key part moves precisely and uniformly. The mechanic switch mechanism 260, which forms the classic, mechanic switch, is surrounded by the guiding mechanism.

The switch mechanism comprises the housing 270 and the contact device 280 with two contact parts: the fixed contact piece 1482 and the elastic contactor 1484. Both contact parts are equipped with so-called crosspoint gold contacts, for example, which enhances durability and reliability of the switch unit 260. The housing 270 of the switch mechanism also has an optical function, wherein the housing 270 is configured to guide light from a light source and distribute it onto an inner surface of the keycap 125.

At the beginning of the actuation, an actuation force at first surges because the guiding mechanism is preloaded by the at least one spring element 240 and the reset force is highest the rest position. This behavior of the key module 120 allows for realizing a very short pre-travel, wherein it can particularly be avoided that a key command is triggered erroneously by accidentally touching a key. If the switch unit was a rubber dome, the increase in force would be significantly more shallow and with a longer pre-travel. After a predefined pre-travel, an actuating element of the keycap 125 contacts the at least one actuation portion 1488 or an actuation tongue of the contactor 1484, and the contacts 1583 and 1585 or crosspoint contacts are closed after a defined path. From this contact on, the force-path characteristic of the key module 120 changes, because the force-path characteristic of the switch mechanism or switch unit 260 is included into the force-path characteristic of the guiding mechanism. From the contact on, the stiffness of the contactor 1484 changes so that the switching point can be perceived by experienced users, wherein the force-path characteristic exhibits a bend. Among other things, this may be advantageous for computer games, because further actuation of the key is not necessarily required, and actions speed and effectiveness in the game can be increased thereby. During further actuation or an overtravel path, the spring body of the at least one spring element 240 hits a bottom cam 1978 or supporting cam of the switch mechanism casing or housing 270. From this moment on, the spring body starts to bend and exhibits an increasing force characteristic, which makes the keystroke soft.

The switch mechanism or switch unit 260 is latchable in a base or the support element 250. The support element 250 of the key module 120 is a stamped part, for example, so that the key module 120 can be realised as a single, SMD solderable part. This allows for flexibly placing the switch units 260 along with other SMD parts, such as LEDs, resistors, diodes etc., on the circuit substrate 110 in one fitting process by means of conventional SMD placement equipment. This reduces overall manufacturing costs, allows for flexible design of the key field of a keyboard 100, and saves investment in machinery, equipment and tools. In consequence of flat soldering pads or soldering surfaces 554 and 582, independence from a thickness of the circuit substrate 110 can be obtained, and the key modules 120 can be fitted on circuit films, for example. As an alternative, the key module 120 can be realized with conventional plug connections and soldered as usual with wave soldering machines.

In the following, different variants for the top part 125 and/or 2025 shall be presented briefly. In a simplified variant, the top part may be realized in form of the keycap 125 as a single part. In this case, keycaps 125 may, for example, be varnished and then lettered according to arbitrary country variants either individually or as an entire key field by means of laser methods. Optionally, the top part may be provided as an intermediate piece 2025 which is designed as a standard part. The keycap 125 a then be realized as a simple shell and be snapped onto the intermediate piece 2025. Lettering may be done as previously described. As an alternative, key symbols may be produced by means of two-component technology, for example. Changing country variants is done by exchanging keycaps 125. The keycap 125 and/or the intermediate piece 2025 can be provided by the customer.

The stabilizing bracket 2190 or key stabilizer can be provided inexpensively. A round wire bent into U shape can be used as the stabilizing bracket 2190. The middle part of the stabilizing bracket 2190 is snapped into the keycap 125 or into the intermediate piece 2025 and pivoted by means of hinges. The support element 250 is formed with two additional lugs in form of the anchoring portions 2156. Among other things, each anchoring portion 2156 comprises an angled region with one bore each for a leg of the stabilizing bracket 2190. For assembly, the legs of the stabilizing bracket 2190 fit into the holes. The anchoring portions 2156 may additionally be soldered to further soldering pads of the circuit substrate 110. This increases mechanical strength of the key module 120. By means of the stabilizing bracket 2190, multiple mechanics for elongated keys and protection against torsional moments and bending as well as for lateral stability can be provided. The anchoring portions 2156 may, for example, be stamped together with the support element 250.

The key module 120 can be constructed according to a modular design principle. The at least one spring element 240 has a function of decoupling the top part 125 and/or 2020 and a function of allowing for free-of-play, uniform movement of the top part 125 and/or 2020. The wing elements 230 and the support element 250 being formed as metal parts offers the advantage that a metal construction is stiff and inexpensive. The force-path characteristic upon actuation exhibits a maximum after minimum actuation path and then an almost linearly decreasing course until after an angular point until contact between the at least one spring element 240 and the cam or cams 1928 and/or 1978.

If an embodiment comprises an "and/or" connection between a first feature and a second feature, this may be read so as to mean that the embodiment comprises both the first feature and the second feature according to one variant of the embodiment and either the first feature or the second feature according to another variant of the embodiment.

REFERENCE NUMERALS

100 keyboard
110 circuit substrate
120 key module
125 keycap
230 wing element
232 mounting portion
234 bearing portion
236 connecting portion
238 end portion
240 spring element
250 support element
252 accommodating portion
260 switch unit
270 housing
272 groove
280 contact device
554 soldering surface
574 receiving bay
582 soldering surface
731 first coupling portion
733 second coupling portion
1335 bar
1337 first arm
1339 second arm
1376 subsection
1482 fixed contact piece
1484 contactor
1486 first spring clip
1488 actuation portion
1583 first contact
1585 second contact
1928 top cam
1978 bottom cam
2025 intermediate piece
2156 anchoring portion
2190 stabilizing bracket
2371 actuation opening
2375 holding portion
2387 second spring clip
2392 auxiliary actuator
2794 attaching portion
2796 nose
2798 fixing portion
3373 deflecting portion

The invention claimed is:

1. A Key module for a keyboard, wherein the key module comprises:

a first wing element and a second wing element for guiding a movement of a top part of the key module upon actuation, wherein each wing element comprises a bar, a first arm and a second arm, wherein the first arm and the second arm each extend away from the bar, wherein a mounting portion is formed on the bar, wherein the first wing element and the second wing element each comprises a first bearing portion formed on the first arm and a second bearing portion formed on the second arm, wherein the first wing element and the second wing element are mechanically coupleable to each other;

at least one spring element for providing a reset force upon actuation of the top part of the key module, wherein the at least one spring element is mountable to the mounting portion of the first wing element and the mounting portion of the second wing element, wherein the at least one spring element is formed as a tension spring;

a support element for supporting the first wing element and the second wing element, wherein a plurality of accommodating portions for accommodating the first bearing portion and the second bearing portion of the first wing element and the second wing element are formed in the support element; and at least one cam for deforming the at least one spring element in an actuated state of the key module, wherein the at least one cam is formed on a switch unit.

2. The key module according to claim 1, wherein the first wing element and the second wing element each comprises coupling portions for mechanically coupling the first wing element and the second wing element to each other, wherein the first wing element and the second wing element each comprises a first coupling portion formed at an end of the first arm and a second coupling portion formed at an end of the second arm.

3. The Key module according to claim 2, wherein the first coupling portion and the second coupling portion of each of the first wing element and the second wing element are formed differently, wherein the first coupling portion of the first wing element is coupleable to the second coupling portion of the second wing element, and wherein the second coupling portion of the first wing element is coupleable to the first coupling portion of the second wing element.

4. The Key module according to claim 2, wherein the first coupling portion of each of the first wing element and the second wing element is formed as a link and the second coupling portion of each of the first wing element and the second wing element is formed as a protruding portion, or wherein the first coupling portion of each of the first wing element and the second wing element and the second coupling portion of each of the first wing element and the second wing element are formed as teeth.

5. The Key module according to claim 1, wherein the first wing element and the second wing element are formed to be identical to each other, and/or wherein each wing element is integrally formed, and/or wherein each wing element is formed of a metal material.

6. The Key module according to claim 1, wherein each wing element comprises at least one connecting portion for connecting the first wing element and the second wing element to the top part of the key module, wherein the top part comprises a keycap or is coupleable to a keycap.

7. The Key module according to claim 6, wherein the at least one connecting portion of each of the first wing element and the second wing element is formed as an elastically deformable beam or as an elastically deformable beam with an end portion bent into a base area region of the bar.

8. The Key module according to claim 1, wherein the support element comprises soldering surfaces or connector pins for attaching the support element to a circuit substrate of the keyboard, and/or wherein the support element is formed of a metal material.

9. The Key module according to claim 1, wherein the support element comprises at least one anchoring portion for anchoring a stabilizing bracket for stabilizing the top part of the key module with respect to torsional moments and bending moments.

10. The Key module according to claim 1, wherein the switch unit comprises a housing and a contact device at least partially arranged in the housing for establishing electric contact upon actuation of the top part of the key module, wherein the contact device comprises a fixed contact piece with a first contact and a contactor with a first spring clip carrying a second contact and at least one actuation portion, wherein the contactor is integrally formed.

11. The Key module according to claim 10, wherein the housing is formed of a transparent or opaque material at least in a subsection or as at least one lens at least in the subsection, and wherein the housing comprises a receiving bay for a light source.

12. The Key module according to claim 10, wherein the contact device comprises soldering surfaces or connector pins for attaching the switch unit to a circuit substrate of the keyboard, and wherein the contact device is formed to establish the electric contact while producing friction between the first contact and the second contact.

13. The Key module according to claim 10, wherein the housing comprises an actuation opening for exposing the at least one actuation portion of the contact device.

14. The Key module according to claim 10, with an auxiliary actuator for actuating the contact device, wherein the housing comprises at least one holding portion for holding the auxiliary actuator, wherein the auxiliary actuator comprises at least one attaching portion for movably attaching the auxiliary actuator to the at least one holding portion of the housing and at least one nose for deflecting the first spring clip.

15. The Key module according to claim 10, with an auxiliary actuator for actuating the contact device, wherein the auxiliary actuator comprises at least one fixing portion for fixing the auxiliary actuator to the first wing element or the second wing element.

16. The Keyboard, wherein the keyboard comprises:

at least one key module according to claim 1; and a circuit substrate, wherein the at least one key module is arranged on the circuit substrate.

17. The Key module according to claim 1, wherein the switch unit comprises a housing and a contact device at least partially arranged in the housing for establishing electric contact upon actuation of the top part of the key module, wherein the contact device comprises a spring clip for producing an actuation sound.

18. The Key module according to claim 17, wherein the housing comprises a deflecting portion for deflecting the spring clip of the contact device upon the actuation of the top part of the key module, wherein the deflecting portion is formed to be inclined obliquely relative to the movement of the top part of the key module upon actuation.

19. The Key module according to claim 17, with an auxiliary actuator for actuating the contact device, wherein the housing comprises at least one holding portion for holding the auxiliary actuator, wherein the auxiliary actuator comprises at least one attaching portion for movably attaching the auxiliary actuator to the at least one holding portion of the housing and at least one nose for deflecting the spring clip of the contact device upon actuation of the top part of the key module.

20. The Key module according to claim 10, wherein at least one groove is formed in the housing for receiving at least one subsection of the at least one spring element in the actuated state of the key module.

* * * * *